US008279422B2

(12) United States Patent
Mooney

(10) Patent No.: US 8,279,422 B2
(45) Date of Patent: Oct. 2, 2012

(54) MEASURING THE MOVEMENT CHARACTERISTICS OF AN OBJECT

(76) Inventor: Brian Francis Mooney, Dun Laoghaire (IE)

( * ) Notice: Subject to any disclaimer, the term of this patent is extended or adjusted under 35 U.S.C. 154(b) by 1427 days.

(21) Appl. No.: 11/721,036

(22) PCT Filed: Dec. 6, 2005

(86) PCT No.: PCT/IE2005/000138

§ 371 (c)(1),
(2), (4) Date: Jun. 6, 2007

(87) PCT Pub. No.: WO2006/061809

PCT Pub. Date: Jun. 15, 2006

(65) Prior Publication Data

US 2010/0048313 A1 Feb. 25, 2010

(30) Foreign Application Priority Data

Dec. 6, 2004 (IE) ..... S2004/0818

(51) Int. Cl.
*G01C 3/08* (2006.01)

(52) U.S. Cl. ..... 356/28; 356/3; 356/3.01; 356/28.5

(58) Field of Classification Search ..... 356/3.01–3.15, 356/4.01–4.1, 5.01–5.15, 6–22, 28, 28.5
See application file for complete search history.

(56) References Cited

U.S. PATENT DOCUMENTS

| | | | | |
|---|---|---|---|---|
| 3,727,069 | A | 4/1973 | Crittenden, Jr. et al. | |
| 4,652,121 | A | 3/1987 | Ito et al. | |
| 4,872,687 | A | 10/1989 | Dooley | |
| 5,481,355 | A | 1/1996 | Iijima et al. | |
| 5,614,823 | A | 3/1997 | Katayama et al. | |
| 5,626,526 | A | 5/1997 | Pao et al. | |
| 5,846,139 | A | 12/1998 | Bair et al. | |
| 5,988,645 | A | 11/1999 | Downing | |
| 6,302,802 | B1 * | 10/2001 | Pao | 473/156 |
| 2004/0239915 | A1 | 12/2004 | Anderson et al. | |
| 2005/0213076 | A1 * | 9/2005 | Saegusa | 356/28 |

FOREIGN PATENT DOCUMENTS

| | | |
|---|---|---|
| JP | 52-6238 | 1/1977 |
| JP | 59-151973 | 8/1984 |
| JP | 63-29550 | 6/1988 |
| JP | 4-279805 | 10/1992 |
| JP | 6-205864 | 7/1994 |
| JP | 7-286838 | 10/1995 |
| JP | 8-117378 | 5/1996 |

(Continued)

OTHER PUBLICATIONS

Japanese Office Action dated Oct. 18, 2010, English translation provided on Nov. 17, 2010, 12 pages.

(Continued)

*Primary Examiner* — Luke Ratcliffe

(57) ABSTRACT

A method of an apparatus for measuring or determining the movement characteristics of an object uses the detection of changes in beams. A set of beams F1-B1, F2-B2, F3-B3 is disposed in the movement path of the object; at relative angles to each other; and at acute angles to the intended direction of the object. The number of changes in the beams or durations between changes in the beams are recorded. The relative times, durations or differences in relative times, at which different beams of the set are changed are measured. The resulting measurements are associated with the relevant movement characteristics of the object.

24 Claims, 13 Drawing Sheets

FOREIGN PATENT DOCUMENTS

| | | | |
|---|---|---|---|
| JP | 08-117379 | | 5/1996 |
| JP | 8117378 | * | 5/1996 |
| JP | 2002-509780 | | 4/2002 |
| JP | 2003-503121 | | 1/2003 |
| WO | 99/49944 | | 10/1999 |
| WO | 2004-021759 | | 3/2004 |

OTHER PUBLICATIONS

Japanese Application No. 2007-545102 Office Action (Decision for Final Rejection) dated Aug. 1, 2011, 2 pages, English translation only.

* cited by examiner

MEASURING THE MOVEMENT CHARACTERISTICS OF AN OBJECT

The present invention relates to a method and apparatus for measuring or determining the movement characteristics of an object by detection of changes to beams, such as the interruption of electromagnetic wave beams. The invention relates more specifically, but not exclusively, to a method and apparatus for measuring or determining the movement characteristics of a substantially straight edge or flat surface, such as the leading edge or face of a golf club. The invention also relates more specifically, but not exclusively, to a method and apparatus for measuring or determining the movement characteristics of an object struck by a substantially straight edge or flat surface, such as a golf ball, which has been struck by a golf club face.

The prior art has produced various devices which claim to measure certain movement characteristics of golf club faces and golf balls by detection of the interruption of electromagnetic wave beams.

Wilson, U.S. Pat. No. 4,150,825; Takase et al., U.S. Pat. No. 4,542,906; Arnold et al., U.S. Pat. No. 5,333,874; Iijima et al., U.S. Pat. No. 5,481,355 and Pao et al., U.S. Pat. No. 5,626,526, all disclose devices which are stated to measure certain movement characteristics of a golf ball passing through one or more substantially vertical, planar arrays of optical beams and sensors, positioned a relatively short distance downstream of the starting position of the ball.

Rusnak, U.S. Pat. No. 4,254,956, discloses a device which is said to measure certain movement characteristics of the shadow of a golf club head passing over a mat comprising a horizontal planar array of optical sensors, the shadow being generated by a single overhead lamp which casts substantially vertical optical beams. The device also proposes means to determine the vertical height of the golf club.

White, U.S. Pat. No. 4,630,829, discloses a device which is stated to measure the speed of a golf club head passing through two pairs of substantially horizontal, transverse optical beams.

Pao, U.S. Pat. No. 6,302,802, discloses a device which is said to measure certain movement characteristics of a golf ball and golf club head passing through a single planar array of optical beams and sensors, positioned a relatively short distance downstream of the starting position of the ball. The planar array is oriented at an angle which is midway between horizontal and vertical. All measurements are taken following completion of impact and contact between the club and ball, when the club no longer retains the characteristics relevant to impact.

None of these prior art specifications discloses a device which can accurately measure the important movement characteristics of a golf club face or of a golf club face and ball.

The present invention seeks to overcome many of the deficiencies of the prior art.

The invention is particularly defined in the appended method and apparatus claims which are incorporated into the description by reference thereto.

The present invention relates to an insight that various motion characteristics of an object moving in a plane can be determined by the interruption or reinstatement of beams in that plane, where the beams are disposed at different angles to each other. The beams may also be at acute angles to the direction of motion or the intended direction of motion.

An aspect of the invention relates to an appreciation that the relative direction and relative speed of an object moving in a plane can be determined by the durations, and differences in durations, between interruptions in two pairs of parallel beams in that plane, where the pairs are lying at different relative angles, provided certain knowledge is available regarding the shape of that part of the object which first interrupts the beams.

A further aspect of the invention relates to an appreciation that the relative angle and relative offset of a substantially straight edge moving in a plane can be determined by the durations, and differences in durations, between the interruptions of a plurality of beams in that plane, where at least three or four lie at different relative angles to each other, provided certain knowledge is available regarding the shape of that part of the object which first interrupts the beams.

Yet another aspect of the invention relates to an appreciation that the relative direction and relative speed of an object moving in a plane can be determined by the durations, and differences in durations, between interruptions and reinstatements of two beams in that plane, where the beams are lying at different relative angles, provided certain knowledge is available regarding the shape of that part of the object which first interrupts and first reinstates the beams.

Where applied to a golf swing, the first said aspect of the invention relates to an appreciation that the relative direction and relative speed of a moving golf ball, or a moving golf club face, projected onto a substantially horizontal plane, can be determined by the durations, and differences in durations, between interruptions in two pairs of parallel beams in that plane, the pairs lying at different relative angles.

The second said aspect of the invention relates to an appreciation that the relative angle and relative offset of a moving golf club face projected onto a substantially horizontal plane, can be determined by the durations, and differences in durations, between the interruptions of a plurality of beams in that plane, where at least three or four lie at different relative angles to each other.

The third said aspect of the invention relates to an appreciation that the relative direction and relative speed of a moving golf ball, projected onto a substantially horizontal plane, can be determined by the durations, and differences in durations, between interruptions and reinstatements of two beams in that plane, the beams lying at different relative angles.

Throughout this specification and accompanying claims, it should be understood that motion characteristics, which occur in three dimensions, may be shown and mathematically treated as projections onto a two dimensional plane, which is sometimes referred to as the common plane. In the preferred embodiment of an apparatus which measures the motion characteristics of a golf ball and the face of a golf club, most of the motion characteristics are dealt with as projections onto a common horizontal plane. The vertical component of the motion characteristics is also accounted, but by separate means.

The invention will now be described more particularly with reference to the accompanying drawings in FIG. 1 to FIG. 10 (*b*), which show, by way of example only, an embodiment of the invention which is suitable as a device which measures the movement characteristics of a golf club face and a golf ball which has been struck by a golf club face.

In the drawings:

FIG. 1 shows a diagrammatic plan view of the detection region of an apparatus, suitable for measuring the motion characteristics of a golf club face and golf ball, including a beam emitting means and a beam detection means. The figure also shows a golf ball placed in position, prior to being struck by the club, and shows an imaginary straight line and arrow head representing the intended direction of motion of the ball from right to left. The emitting means, shown on the upper region of the figure, emits five pairs of beams which are detected by the detection means, shown on the lower region of the figure. Each pair of beams comprises two beams at reversed angles with their intersections lying on the line of the intended direction of movement of the ball. The figure includes an identifying label on each beam, the labels being shown on the lower part of the view for beams emitted in the forward direction, and shown on the upper part of the view for beams emitted in the backwards direction.

For convenience throughout this specification and appended claims, angles to the intended direction which are of equal magnitude, but are disposed in opposite rotations relative to the intended direction, will be referred to as being "reversed" angles to each other. Any reference to beams being disposed in "opposite rotation" or "same rotation" relative to the intended direction, refers to the direction, and not the magnitude, of rotation of the beam relative to the intended rotation, noting also that beams typically comprise an emitter-to-detector orientation. For convenience throughout this specification and appended claims, reference is also made to the "intended direction". In a two dimensional case, this usually refers to the most typical direction of motion of the object being measured, and will usually correspond to the target direction or intended direction. However, in some instances the actual target direction may sometimes differ from the typical direction. In a three dimensional case, the intended direction will relate to the typical, target or intended direction of motion projected onto the common plane.

Three pairs of beams are positioned on the club incoming side of the ball, to its right, and two are positioned on the outgoing side, to its left. Two of the pairs of beams on the incoming side have beams which are parallel to each other and have intersections which are spaced apart. The third pair of beams is set at different reverse angles, but has its intersection coincident with one of the other pairs. Both pairs of beams on the outgoing side have beams which are parallel to each other and have intersections which are spaced apart.

FIG. 2 shows a magnified view of the central incoming region of the apparatus illustrated in FIG. 1, but with the third pair of beams omitted for clarity. It also shows four representations of the club face approaching the ball, each representation showing the club face position as it first interrupts each of the four beams. Each representation relates to the substantially flat surface or leading edge of the club face, as projected onto the horizontal plane. The figure also shows various construction lines and angles used in the determination of club face direction and club face speed.

Figure 1:
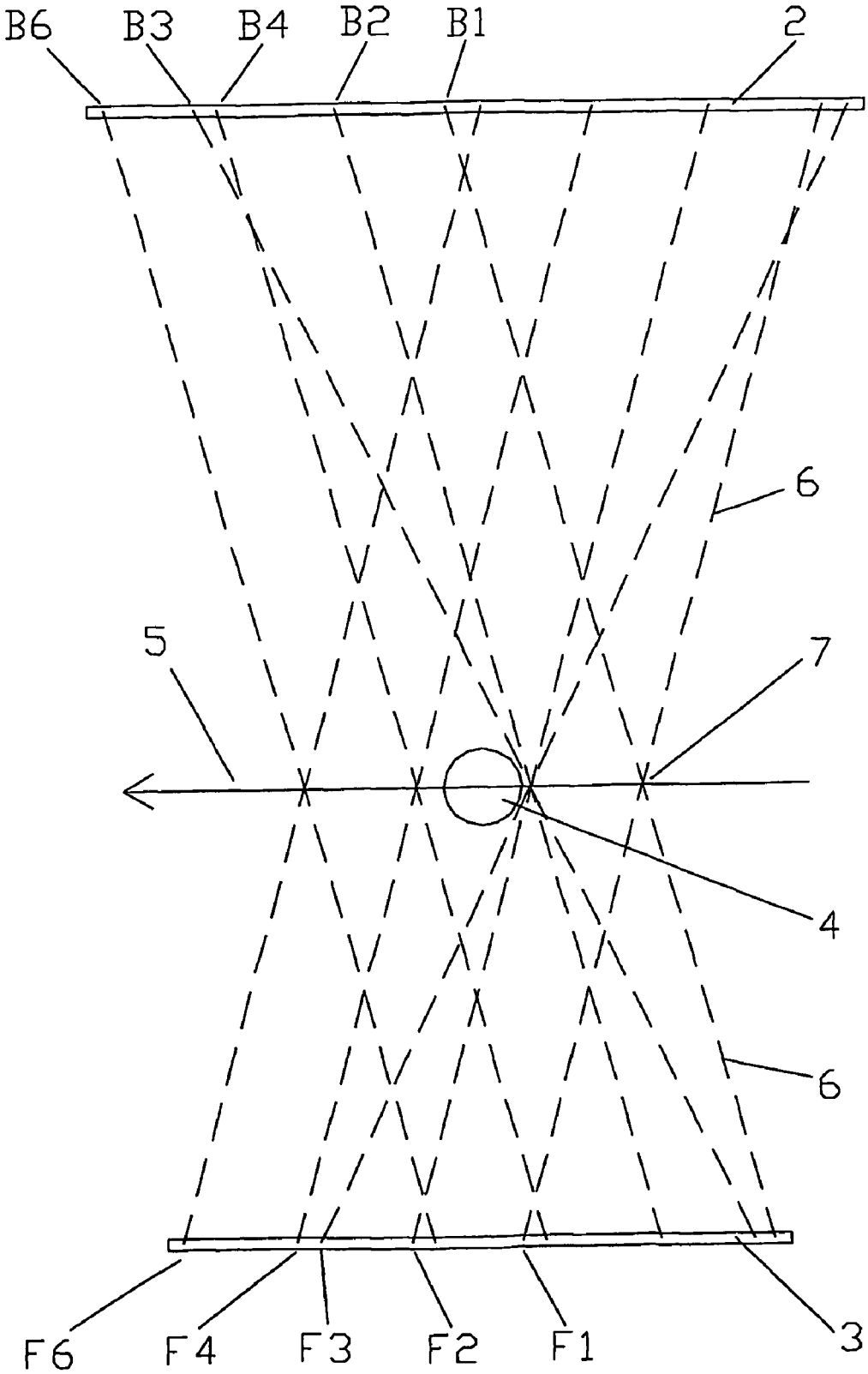
Figure 5:
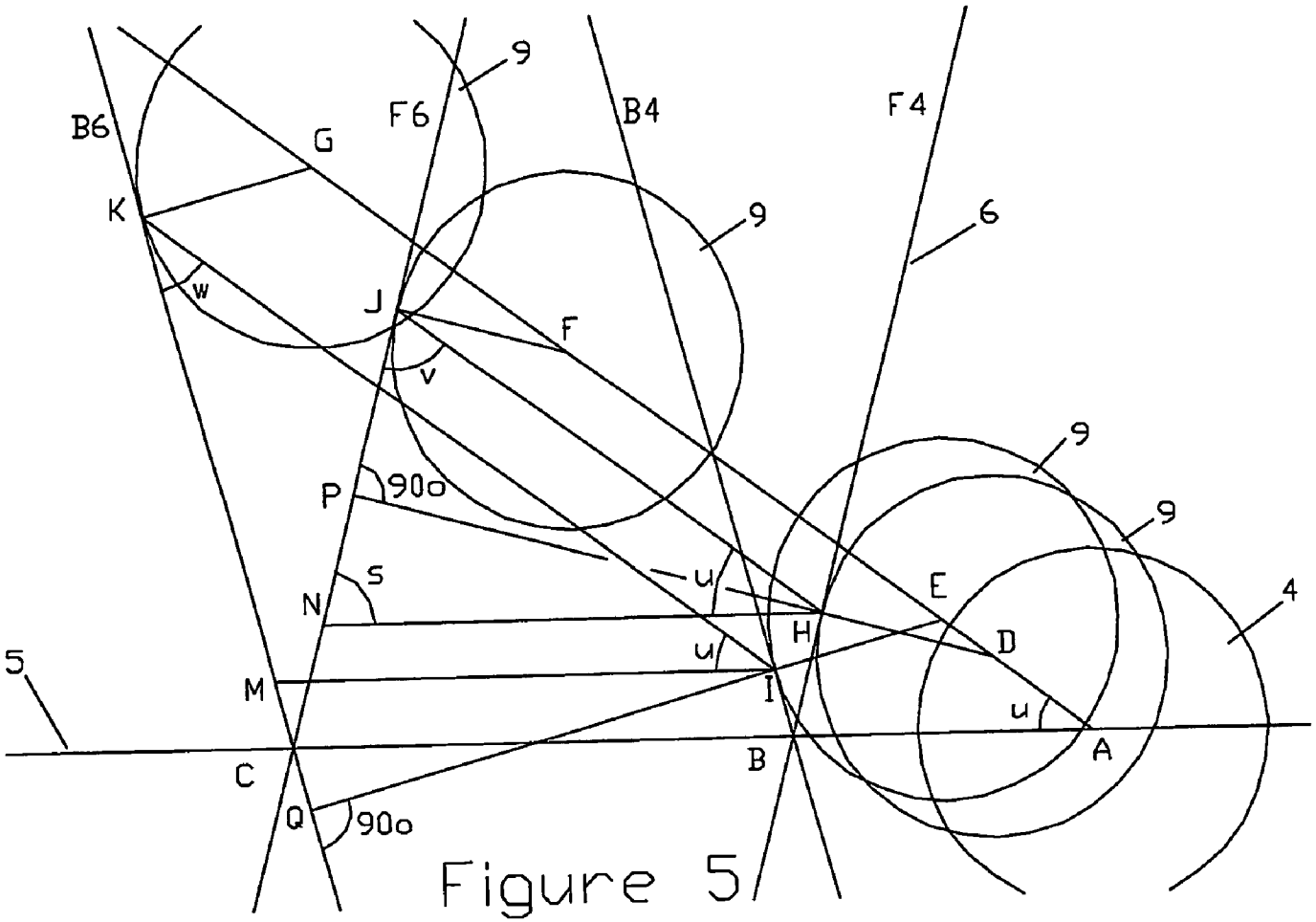

FIG. 5 shows a magnified view of the central outgoing region of the apparatus illustrated in FIG. 1. It also shows four additional representations of the ball after an impact which hits the ball in a direction to the right of the intended direction. Each representation shows the ball position as it first interrupts each of the four beams. The figure also shows various construction lines and angles used in the determination of ball movement direction and ball speed.

Figure 6:
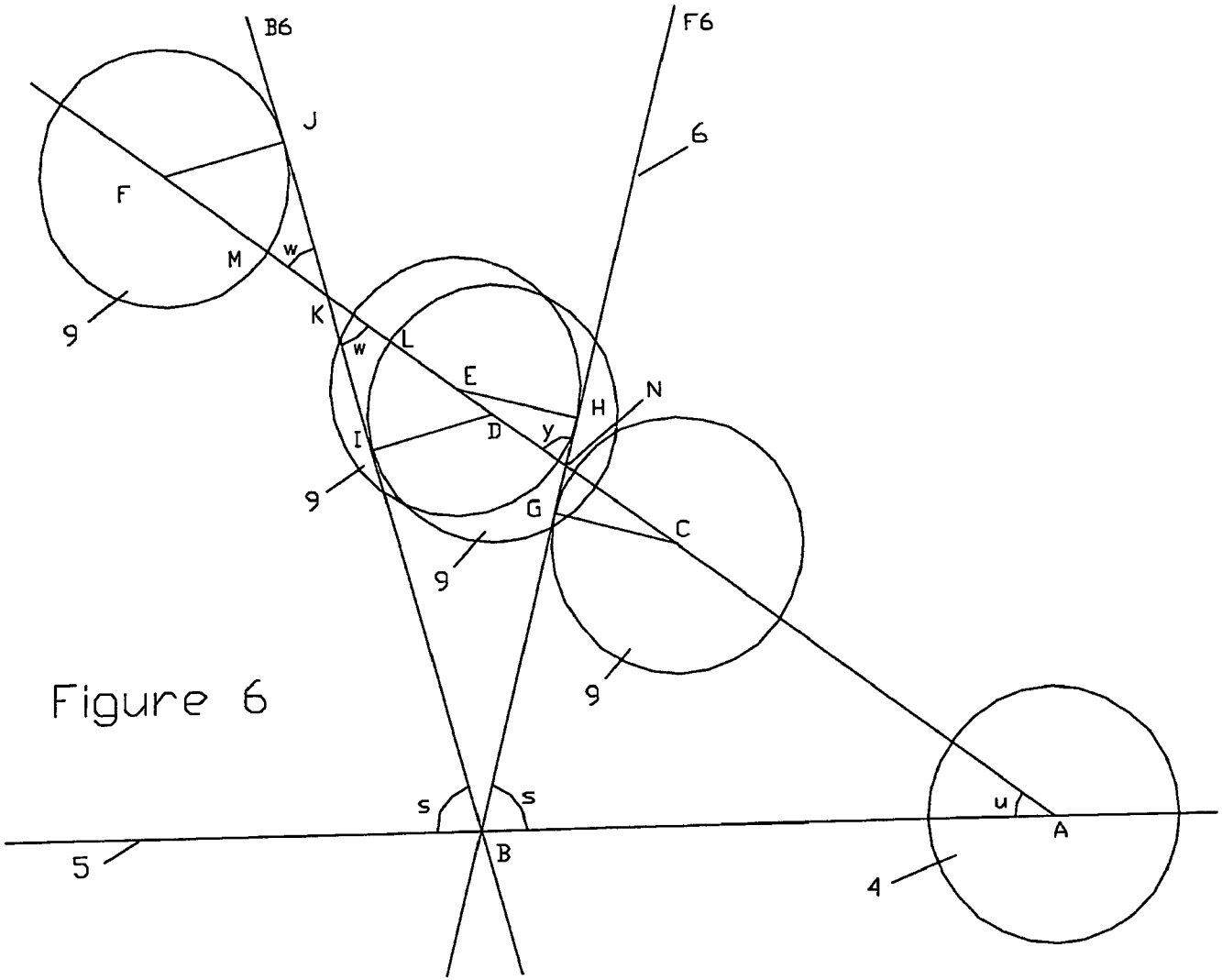

FIG. 6 shows a magnified view of the central outgoing region of the apparatus illustrated in FIG. 1, but in this instance with just one pair of intersecting beams. It also shows four additional representations of the ball after an impact which hits the ball in a direction to the right of the intended direction, similar to that shown in FIG. 5. Each representation shows the ball position as it first interrupts and first reinstates each of the two beams. The figure also shows various construction lines and angles used in the determination of ball movement direction and ball speed.

Figure 7:
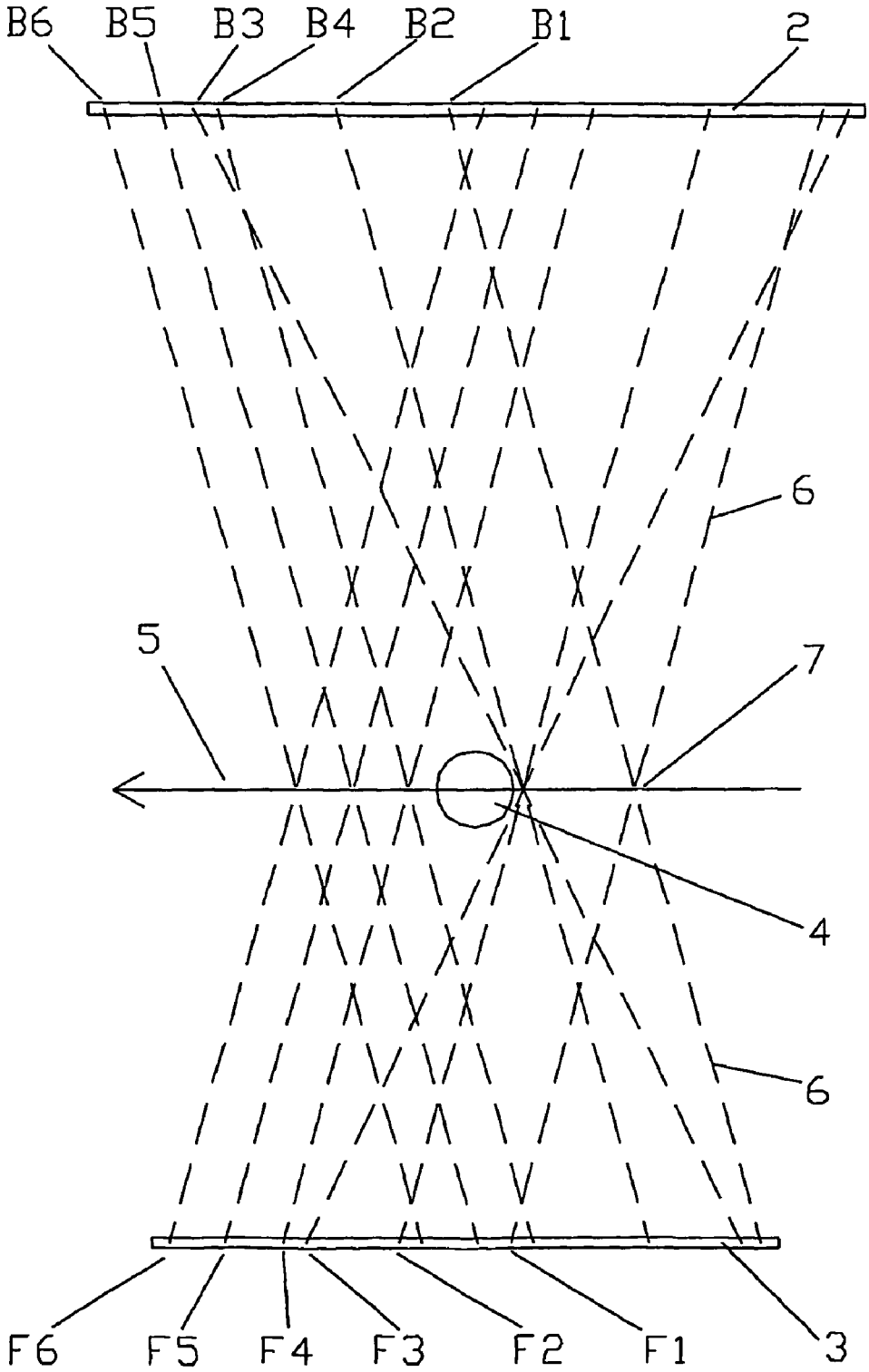

FIG. 7 shows a similar view to FIG. 1, but with an additional pair of beams on the outgoing side, comprising two beams at reversed angles with their intersections lying on the line of the intended direction of movement of the ball, but spaced apart from the intersections of the other beams. The beams in this pair are parallel to the beams in the other outgoing pairs.

In the description of the preferred embodiment, the emitting means and detection means may be referred to as the emitter and detector, respectively.

Figure 8:
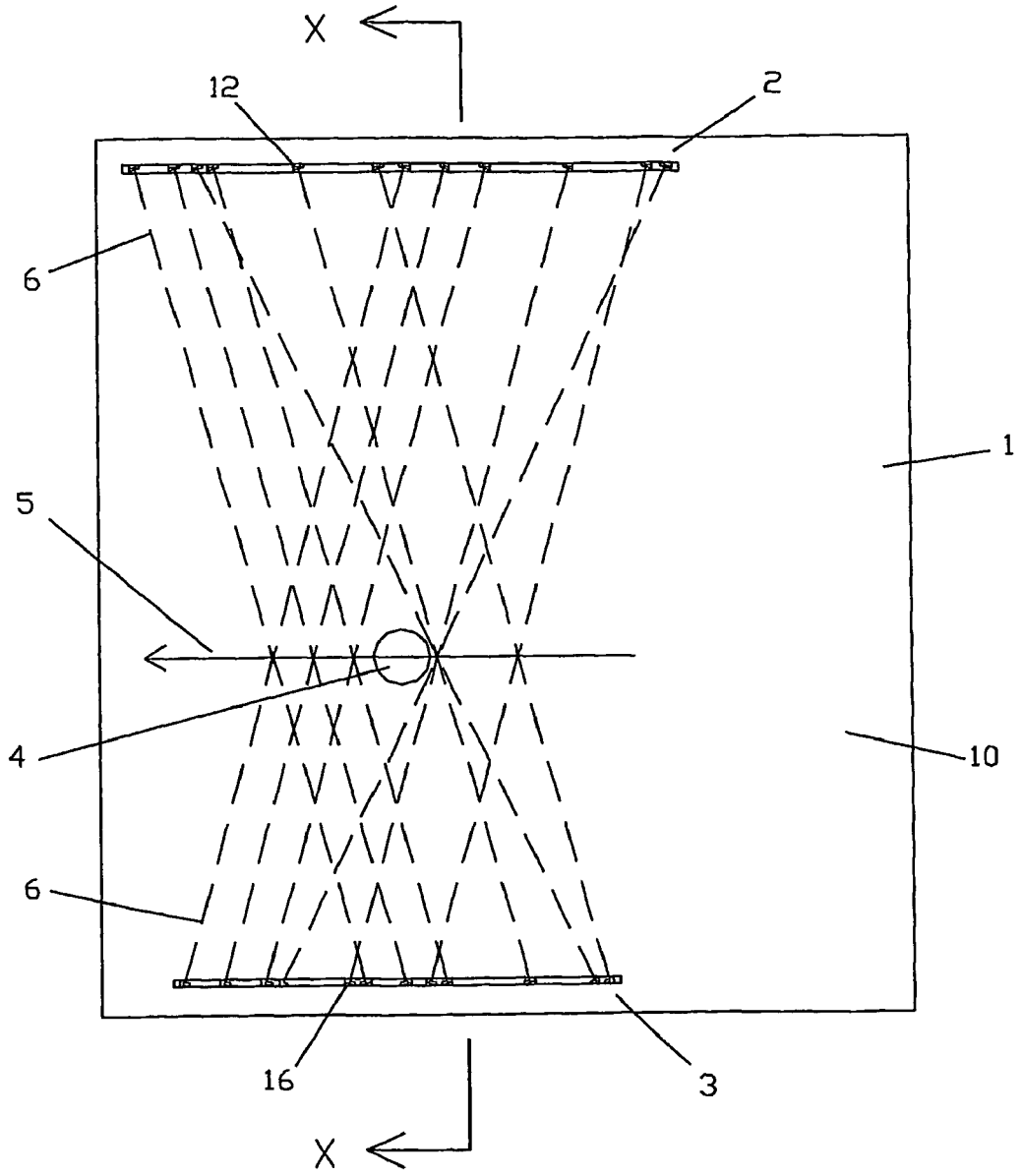

FIG. 8 shows a diagrammatic plan view of the apparatus, shown in FIG. 7. The figure includes an emitter reflector, a detection reflector and a playing surface. The view includes a depiction of the central collimated beams as dashed lines.

Figure 9:
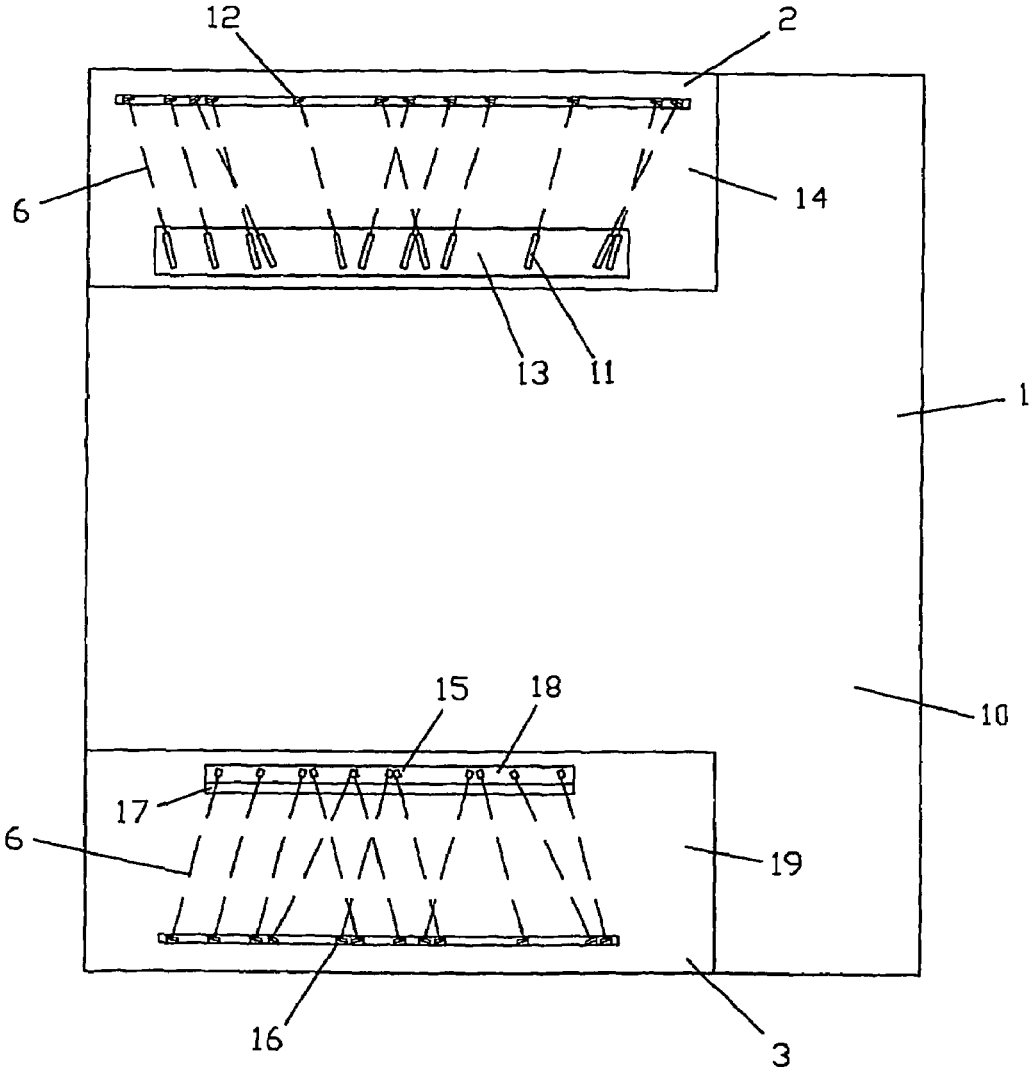

FIG. 9 shows a diagrammatic cut away plan view of the apparatus shown in FIG. 8, showing the arrangement beneath the playing surface, but retaining the views of the emitter reflector and detection reflector. The view includes a depiction of the uncollimated beams as dashed lines.

Figure 10:
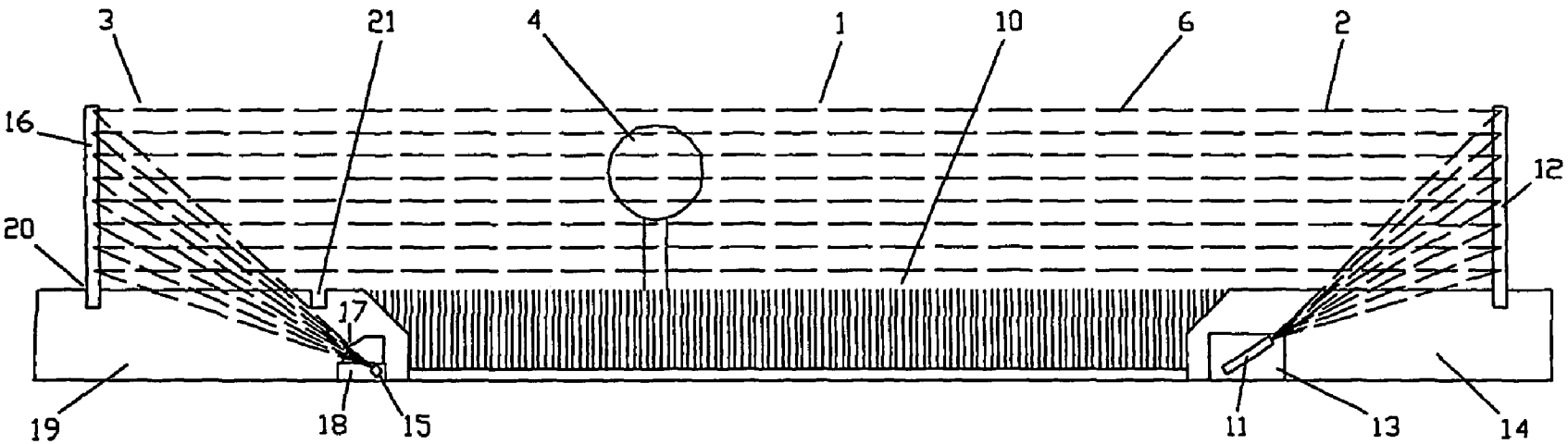

FIG. 10 shows a side sectional view on X-X of the apparatus shown in FIGS. 8 and 9. The arrangement is suitable for detection of the movement characteristics of a golf shot where the ball is hit from a tee-ed position.

Figure 11:
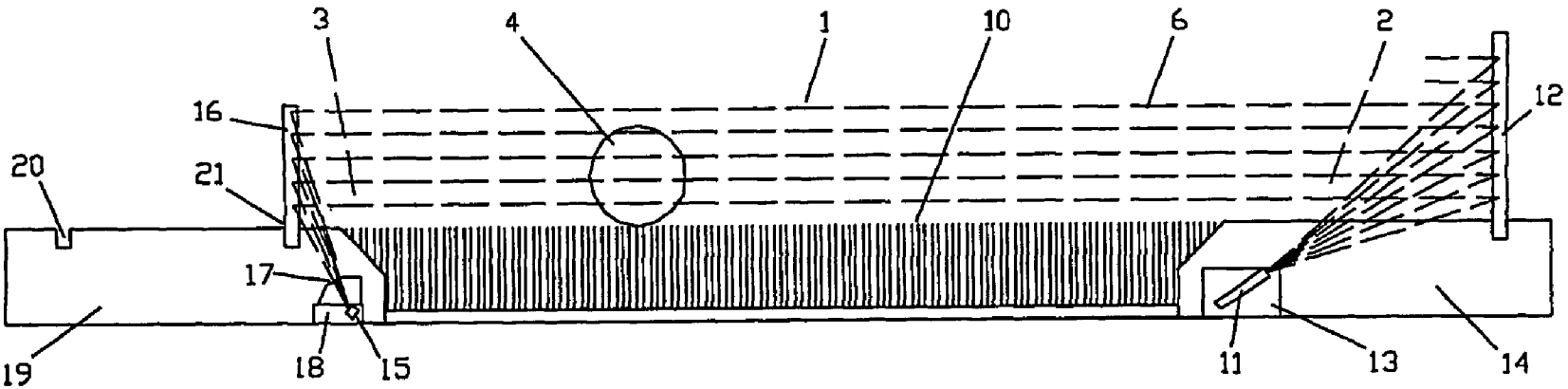

FIG. 11 shows a view similar to FIG. 10, but in this instance the arrangement is suitable for detection of the movement characteristics of a putting shot.

Figure 12:
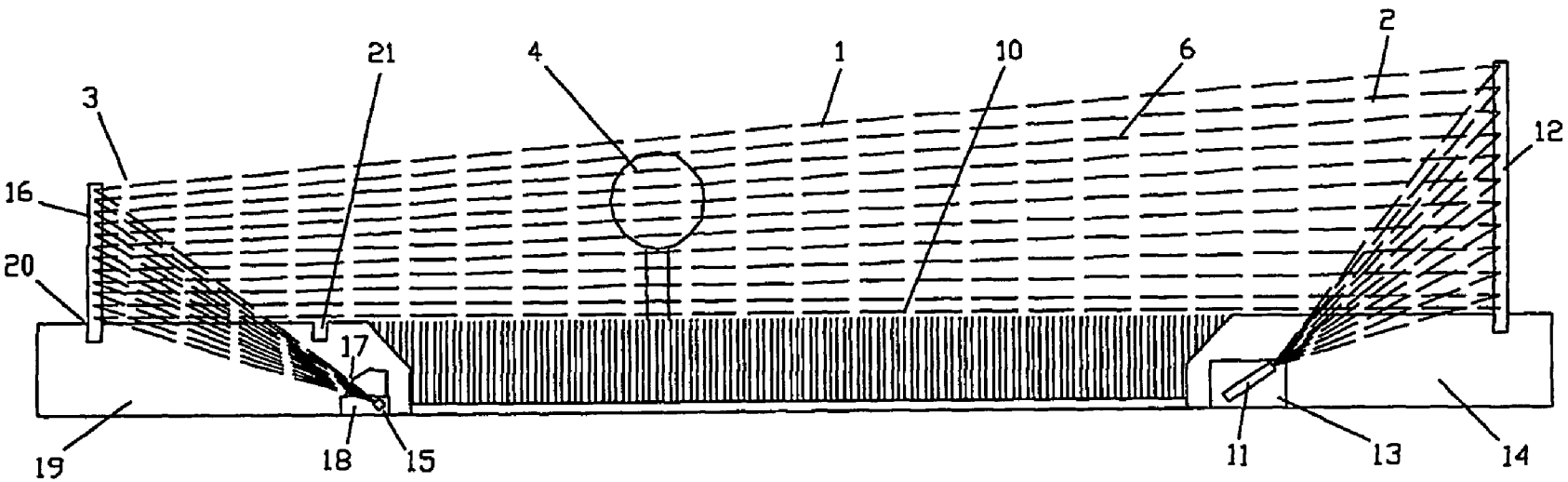

FIG. 12 also shows a view similar to FIG. 10, but where the detection reflector is of lesser height than the emitter reflector.

Figure 13:
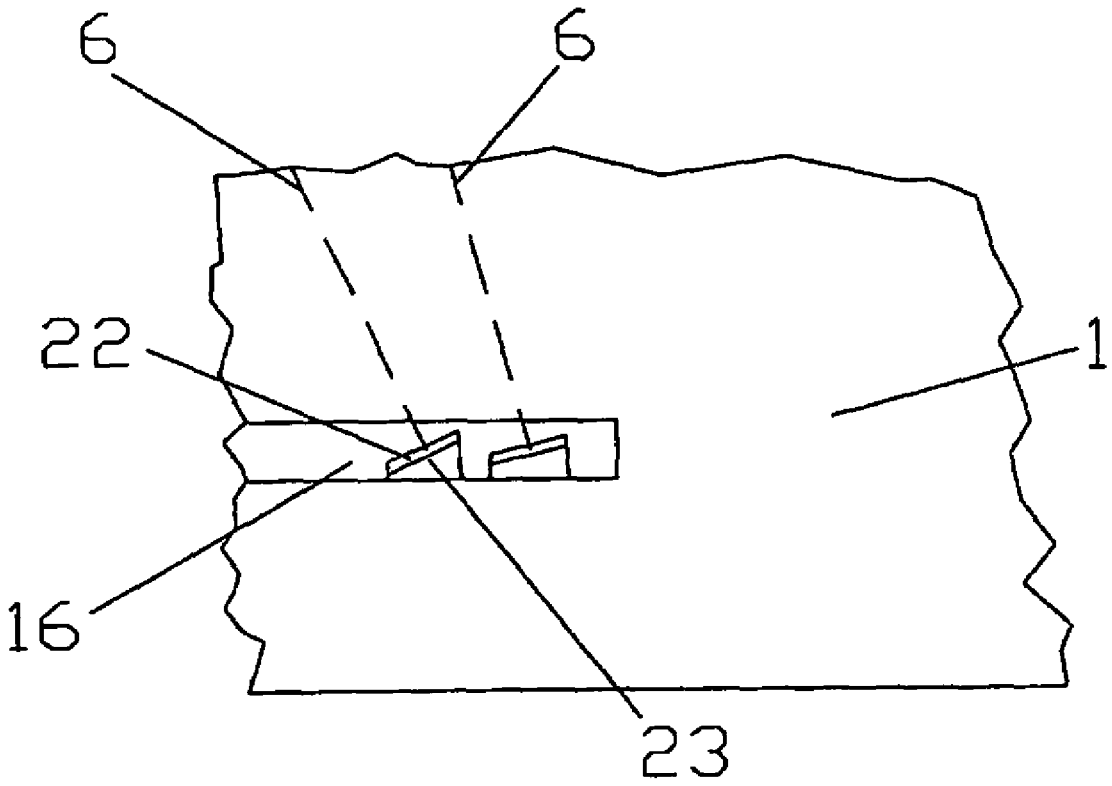

FIG. 13 shows the lower right hand corner of the apparatus, shown in FIG. 8, on a larger scale. The view includes a portion of the detection reflector.

The following is an index of the reference numerals used in the drawings:

1. Apparatus
2. Emitting means
3. Detection means
4. Ball at starting rest position
5. Line showing intended direction of flight
6. Beam
7. Beam intersection
8. Representation of a moving club face
9. Representation of a moving ball
10. Playing surface
11. Emitter radiation source and first lens
12. Emitter reflector
13. Emitter array block
14. Emitter means base
15. Detector
16. Detection reflector
17. Detector screening means
18. Detector array block
19: Detection means base
20. Detection reflector base support at outer location.
21. Detection reflector base support at inner location.
22. Reflector facet.
23. Metallised surface of reflector facet.

Measurement of Club Face Movement

Referring to FIGS. 1 to 4, the arrangement comprises three pairs of beams, F1-B1, F2-B2 and F3-B3. Each pair comprises two intersecting beams, which substantially lie in the horizontal plane. The beams are positioned relative to the ball such that the club face interrupts them prior to striking it.

The intersections of each pair of beams lie on a straight line which passes through the centre of the ball and lies in the horizontal plane. It is also coincident with the projection of the intended flight direction of the ball on the horizontal plane, or 'intended direction'. Beams F1 and F2 lie at equal angles, S, to the intended direction. Beams B1 and B2 also lie at equal angles, S, to the intended direction, but in opposite directions of rotation to those of F1 and F2, i.e. they are disposed at 'reverse' angles to each other. Beams F3 and B3 similarly lie at reverse angles to each other, in this instance the angle being T to the intended direction of flight. Angles S and T are shown at 75° and 65°, respectively, in the figures. The principal considerations to be taken into account when setting these angles are as follows. The angles of the F1-B1, F2-B2 and F3-B3 beams, relative to the intended direction, must exceed the maximum range of the angle of the club face over which measurement is made. To obtain reasonable accuracy, the angles of the F3-B3 must be significantly different to the F1-B1 and F2-B2 beams. To minimise the lengths of the emitter means and detection means, the angles should be maximised within the design constraints. The chosen angles are a balance between these partly opposing considerations.

The intersections of beam pairs F2-B2 and F3-B3 are coincident. They are spaced a small distance from the edge of the ball, sufficient to ensure that the beams are clear of the ball surface. In the figure, this distance is shown as 5 mm. The intersection of beam pair F1-F2 is spaced a distance away from the joint intersection of beam pairs F2-B2 and F3-B3. In the figure, this distance is shown as 50 mm in FIGS. 2 and 4 and 60 mm in the other figures.

Each of the figures shows the same example of club swing movement, which is deliberately made imperfect in respect of club movement direction, club face angle and club face position relative to the impact point on the ball. Club movement direction is shown at an angle −U, relative to the intended direction. Club face angle is shown at an angle +Z, relative to the club face direction and therefore −(U-Z) to the intended direction. The club face position at impact is shown with the impact occurring off-centre closer to the toe of the club.

The apparatus is operable to determine the club movement direction, club speed, club face angle and club face position at impact by calculation methods which commence with an accurate recording of the times at which the six incoming beams are first interrupted. For convenience, the characteristic related to club face position at impact will be referred to as club face "offset" throughout this specification.

Club Face Direction

The determination of club movement direction relies on a recognition that the distance traveled by any point on the club face between the two parallel beams F1 and F2, or the two parallel beams B1 and B2, will vary with the relative angle of direction to the beam, becoming shorter as the club direction of motion becomes more closely aligned with the perpendicular to the beam and becoming longer as it becomes less closely aligned. Accordingly, since the two pairs of parallel beams lie at different angles, the ratio of the distance traveled between them provides sufficient information to give a direct indication of the relative angle of direction of club motion.

Referring again to FIG. 2, this shows a club face travelling in a direction parallel to lines DA and HE, at an angle of magnitude U to the intended direction. The club face is represented by DH, CG, BF and AE where it first encounters beams F2, F1, B1 and B2 respectively.

All references to club faces refer to its substantially straight leading edge, as projected in the horizontal plane. For example, in the case of line DH, point D represents the corner of the flat leading edge of the club closest to its toe or distal end. Point H represents the corner closest to its heel or shaft end.

The club face is assumed to remain at a substantially constant speed and at a substantially constant angle to its direction of motion as it first interrupts the four beams. Therefore the two time intervals which are recorded between F1 and F2, and between B1 and B2 being broken will be in proportion to the distances AC and FH, respectively. Therefore, measurement of these two time intervals will provide the ratio AC/FH.

The figure also shows a perpendicular line CJ drawn from point C onto the line representing beam F2 and a perpendicular line HK drawn from point H onto the line representing beam B2.

Triangle CAJ is a right angled triangle, and angle CAJ S+U.

Therefore, CJ=AC×sin (S+U).

Triangle KFH is a right angled triangle, and angle KFH=S−U.

Therefore, HK=FH×sin (S−U).

Since the two pairs of parallel beams are equally spaced apart, CJ=HK.

Therefore, FH×sin (S−U)=AC×sin (S+U), and

AC/FH=sin (S−U)/sin (S+U).

Since S and the ratio AC/FH are known, it is therefore possible to calculate the angle of club movement direction, U, relative to the intended direction.

The expression AC/FH=sin (S−U)/sin (S+U) indicates that the ratio of the relative times, or differences in relative times, between changes in one parallel pair compared to another parallel pair has a fixed relationship to the angle of club face direction and angles of the beams.

Club Speed

The speed of the club face, as projected in the horizontal plane, can be determined when the angle of club movement, U, is determined, since this allows distances to be calculated between two recorded instances of the beams being first interrupted. The parallel pairs of beams provide the framework for this distance calculation.

Referring again to FIG. 2, it can be seen that where the toe end corner of the club face first interrupts beams F1 and F2 at C and A, respectively, the distance traveled is AC. Since the distance CJ between parallel beams is a known characteristic of the apparatus, AC can therefore be calculated, since AC=CJ/sin (S+U). Referring to the time duration between the recorded first interruptions of F1 and F2 as TF, the speed is therefore given by $$\text{Speed}=(\text{distance})/(\text{time})=TF/[CJ/\sin(S+U)].$$

The speed can also be determined where the heel end of the club first interrupts beams B1 and B2. Since HK=CJ, where the time duration between the recorded first interruptions of B1 and B2 is referred to as TF, then similarly $$\text{Speed}=(\text{distance})/(\text{time})=TB/[CJ/\sin(S+U)].$$

Where club motion is in a straight line, both values for speed should be the same and an average may be taken if the results differ slightly.

Club Face Angle and Offset

A club face which is at an angle to the orthogonal to the intended direction will contact the beams in a different manner to one which is orthogonal to it. In general, for the arrangement shown in the figures, where the club face is increasingly "open" (i.e. where the club face is increasingly angled clockwise away from the orthogonal to the intended direction), the corner of the club face nearest the heel will contact the beams sooner than it would otherwise do and the corner nearest the toe will contact it later. Conversely, where the club face is increasingly "closed" (i.e. where the club face is increasingly angled clockwise away from the orthogonal to the intended direction), the corner of the club face nearest the heel will contact the beams later than it would otherwise do and the other corner will contact it sooner.

Also, an offset club face, i.e. a club face which is travelling such that the locus of its centre is offset from the intersection of the beams and the centre of the ball, will contact the beams in a different manner to one which is aligned to the intersection and the centre. In general, for the arrangement shown in the figures, with increased offset of the centre of the club face closer to the player, the corner of the club face nearest the heel of the club will contact the beams sooner than it would otherwise do and the corner nearest the toe of the club will contact it later. Conversely, with increased offset of the centre of the club face away from the player, the corner of the club face nearest the heel will contact the beams later than it would otherwise do and the corner nearest the toe will contact it sooner.

The characteristics relating to the angle and offset of the club face each affect the relative sequences at which the corners of the clubface first interrupt the beams, and the relationships are also affected by the fixed angle between the beams and the intended direction. An aspect of the present invention relates to a realisation that these relationships are affected differently for changes in angle and changes in offset and that it is possible to use these differences to distinguish angle and offset where use is made of two sets of beams at different angles to the intended direction.

One important difference relates to the manner in which club face angle and club face offset affect the first interruption of groups of beams which are at different angles and groups of beams which are at reverse angles, in each case relative to the intended direction. For example, where the shot is otherwise straight and even, an angled club face will cause F2 and B2 to be first interrupted at different times, and will also cause F3 and B3 to be first interrupted at different times, it will have a similar or identical effect on the relative first interruption between F2 and F3 as it will on the relative first interruption between B2 and B3. This is not the case for a club face which is offset, where the shot is otherwise straight and even. In this instance, the offset will similarly cause F2 and B2 to be first interrupted at different times, and will cause F3 and B3 to be first interrupted at different times, but it will have quite a different effect on the relative first interruption between F2 and F3 as it will on the relative first interruption between B2 and B3. The first interruption difference will be relatively greater between F2 and F3 if the club face is offset away from the player and will be relatively greater between B2 and B3 if the club face is offset closer to the player.

These aspects apply to the general case of the measurement of the angle or offset of an edge. The set of beams comprises two beams disposed in one rotation at different acute angles to the intended direction and either, two further beams disposed in the opposite rotation at different acute angles to the intended direction, or one further beam disposed in the opposite direction at an acute angle. When the edge passes through the set of beams, the angle of the edge will be indicated closer to the angle of beams which are changed later and further from the angle of beams which are changed sooner. Also, the offset of the edge will be indicated closer to the region comprising the most forward beam which is changed sooner and being indicated further from the region comprising a beam which is changed later. An increased difference between relative changes between beams of opposite rotation indicating the movement characteristic to be progressively angle rather than offset, and a reduced difference between relative changes between beams of the same rotation indicating the movement characteristic to be progressively offset rather than angle.

An important feature of these aspects is that a unique measurement of angle and offset can be obtained by appropriate mathematical analysis of the changes. A more complete understanding will be gained by the trigonometric analyses in the following paragraphs, applied to the example shown in the figures.

Club Face Angle

Figure 3:
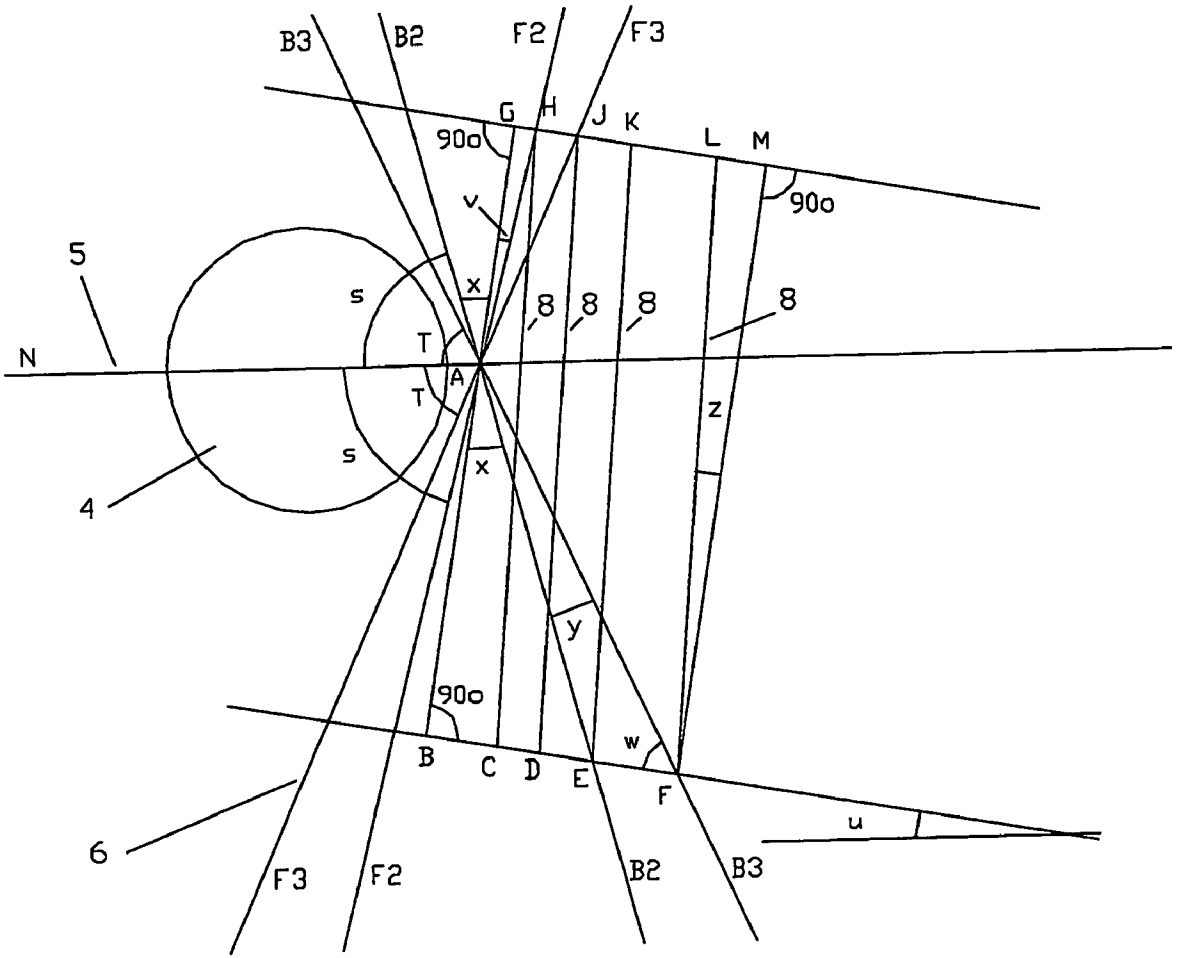
FIG. 3 shows a similar view to FIG. 2, except than in this instance the omitted pair of beams is that which has its intersection spaced apart from the others. It also shows various construction lines and angles used in the determination of club face angle.

Referring now to FIG. 3, this shows a close up view of the arrangement with beam pair F1-B1 omitted for clarity. The figure shows a club face travelling in a direction parallel to lines GM and BF, at an angle U to the intended direction. The club face is represented by FL, EK, DJ and CH where it first encounters beams B3, B2, F3 and F2, respectively.

Figure 2:
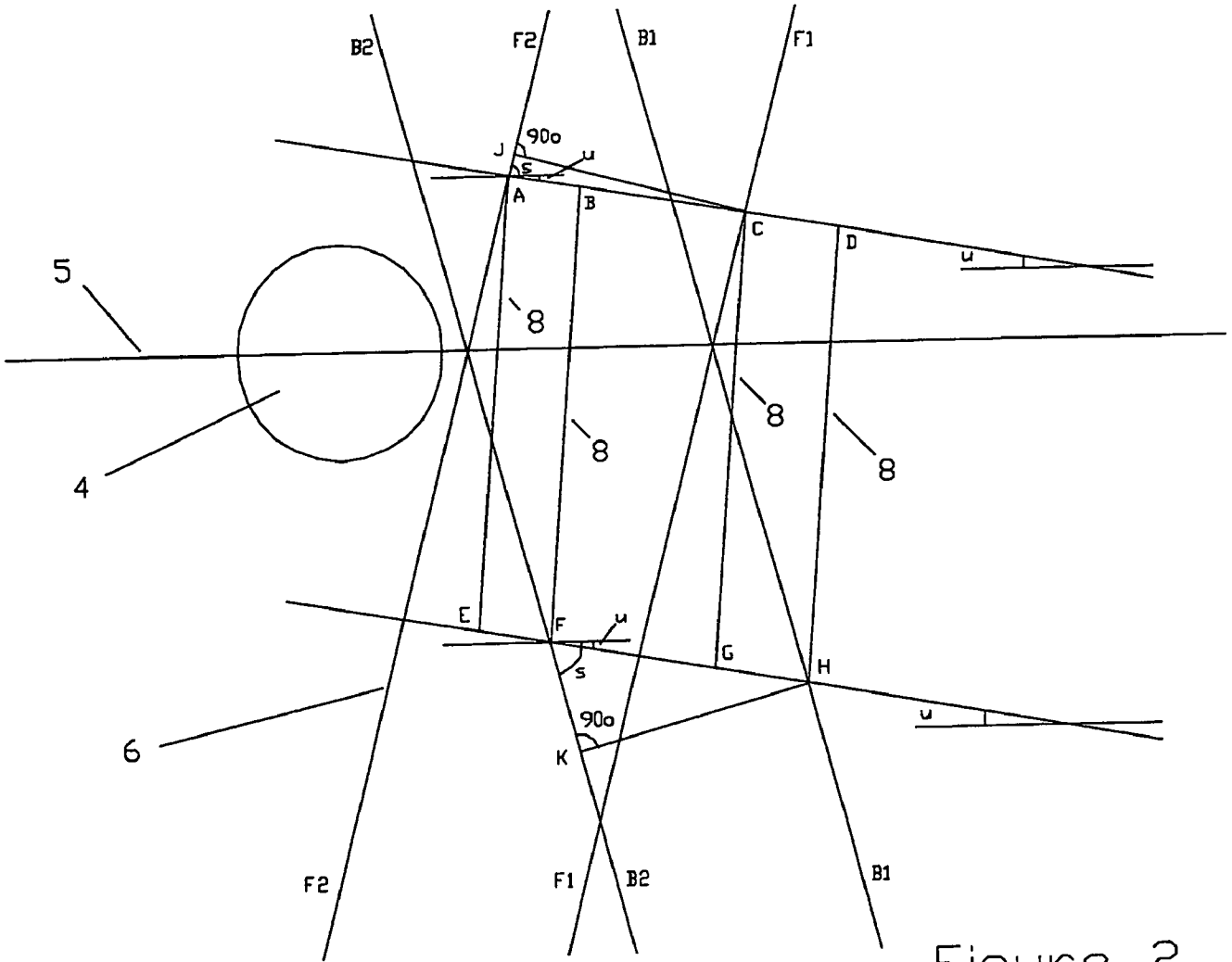

The motion of the club face is the same as that shown in FIG. 2 and the club face is again assumed to remain at a substantially constant speed and at a substantially constant angle to its direction of motion as it passes through the four beams. The club face is at an angle to a perpendicular to the direction of motion and is also at an angle to a perpendicular to the intended direction. The locus of motion of the centre of the club face is also offset from the intersection of the beams, A, and from the centre of the ball.

The system takes a time measurement as each beam is first interrupted and from this determines the lengths KL, JK and HJ from knowledge of the club speed and the times taken to traverse those distances, as directly measured by sensors on the F2, B2, F3 and B3 beams. This also determines the lengths of EF, DE and CD, which equal KL, JK and HJ, respectively.

The figure shows two further lines, BG and FM. BG passes through A and is perpendicular to BF and GM. FM commences from point F and is also perpendicular to BF and GM. The figure further defines angle GAH as "V", angle AFB as "W", angle BAE as "X", angle EAF as "Y", and angle LFM as "Z".

Y is known, because Y=S−T, both of which are known.

Since GA lies at an angle U to the perpendicular to the intended direction, observation of angle GAN shows that X+S=90°+U. Therefore, X is known, because S and U are known.

W is known because, ABF is a right angle triangle with (X+Y)+W=90°, and X and Y are known.

V is also known, because the straight angle to the left of the F2 beam, about point A, is equal to 180°=V+X+2S. Therefore, V=[180°−X−2S]=[180°−(90°+U−S)−2S]=[90°−U−S].

AB is found as follows. AE is first found by application of the standard trigonometric solution for the oblique sided triangle AEF, i.e. AE=EF×sinW/sinY. Therefore AE is known, since EF, W and Y are known. EF has been determined by measurement of the first interruption of beams B3 and B2. Therefore, AB is found since AB=AE×cosX.

AG is found in a similar manner to AB, as follows. AH is found by application of the standard trigonometric solution for the oblique sided triangle AHJ, in which angle HJA=T+U and angle HAJ=Y. i.e. AH=HJ×sin(T+U)/sinY. Therefore AH is known, since HJ, W and Y are known. HJ has been determined by measurement of the first interruption of beams F2 and F3. Therefore, AG can be found since AG=AH×cosV, and V and AH are known.

The sides of triangle LMF can now be determined as follows. GM is known, since GM=BF, BF=BE+EF and EF is known and BE=AB×tanX. GH is known, since GH=AG×tanV, and AG and V are both known. LM is known, since LM=GM−(GH+HJ+JK+KL), and GM, GH, HJ, JK and KL are all known. FM is known, since FM=AB+AG, and AB and AG are known.

The angle of the club face relative to the orthogonal to the direction of movement of the club, Z, can now be determined from triangle LMF. Z is known, since tanZ=LM/FM and LM and FM are both known. The angle of the club face relative to the orthogonal to the intended direction is equal to (Z+U).

Club Face Offset

It can be appreciated from FIG. 3 that point A is (AB−AG)/2 distant from the mid point of line BG. Therefore the offset of the locus of motion of the centre of the club face from the intersection of the F2-B2 and F3-B3 beams, A, is given by (AB−AG)/2, where the offset is measured at right angles to the direction of motion of the club. Where the club is not travelling in the same direction as the intended direction, this offset will not be the same as the offset from the centre of the ball. The offset from the centre of the ball can be determined by adding or subtracting, as appropriate, to the offset relative to the intersection, the additional offset component due to the ball travelling at an angle different to the intended direction. This is illustrated in FIG. 4.

Figure 4:
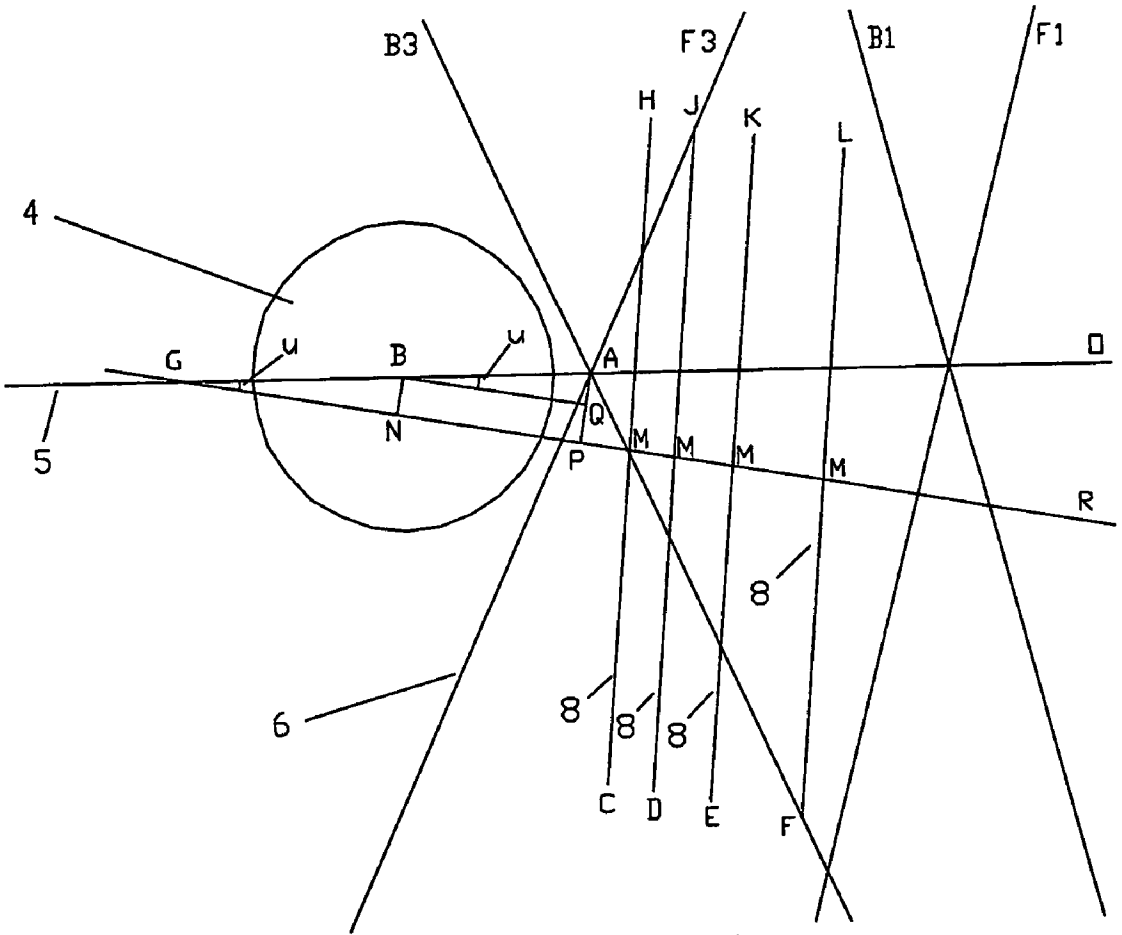
FIG. 4 shows a similar view to FIG. 2, but includes an imaginary straight line passing through the midpoints of the representations of the club face. It also shows various construction lines and angles used in the determination of the position of the club face relative to the impact point on the ball.

Referring now to FIG. 4, this shows a swing which is identical to that shown in FIG. 3, with the club face again represented by FL, EK, DJ and DH where it first encounters beams B3, B2, F3 and F2, respectively. For clarity, beams F2 and B2 are omitted from the figure. B is the centre of the ball and A is the intersection of beams F3, B3, F2 and B2. Each of the club face positions shown in the figure has a mid point M. RG is the locus of these mid points. The club face mid point moves in a substantially straight line movement over the short distance approaching the ball. RG is at an angle U to the intended direction OG.

AP, the perpendicular line from point A onto line RG, is the offset distance from the locus of the midpoints to the intersection of the beams. It is equal to the value (AB−AG)/2 shown in FIG. 3, as discussed earlier.

BN, the perpendicular from the ball centre onto line GR, is the offset distance from the locus of the midpoints to the centre of the ball. It can be determined as follows. BN=AP−AQ, since BN=PQ. AQ=AB×sinU. AB and U are known, AB being the fixed distance between the ball centre and the intersection of the beams.

The offset BN is a significant characteristic of the golf swing since it is a direct measure of the horizontal component of "sweetness" of the swing, or how close mid point of the club face is to the point of impact, since the mid point is commonly understood to coincide with the centre of inertia of the club. Where a different point on the club face is known to coincide with the centre of inertia, the calculation should be adjusted as appropriate. It is noted that the horizontal component of sweetness is considered to be of more importance than the vertical component because of the likelihood that a horizontally offset clubface will cause the clubface to rotate substantially about the axis of the club shaft at impact, whereas a vertically offset clubface is more securely restrained against rotation by the club shaft.

Measurement of Ball Movement

Referring to FIG. 1 and FIG. 5, the arrangement comprises two pairs of beams, F4-B4 and F6-B6. Each pair comprises two intersecting beams, which substantially lie in the horizontal plane.

The intersections of both pairs of beams lie on a straight line in the intended direction, and which passes through the centre of the ball and lies in the horizontal plane.

Beams F4 and F6 lie at equal angles, S, to the intended direction. Beams B4 and B6 lie at equal reverse angles to those of F4 and F6. Angle S is shown at 75° in the figures.

The intersection of beam pair F4-B4 is spaced a small distance from point where the ball separates from the club face after impact. In the figure, this distance is shown as 15 mm. The intersection of beam pair F6-B6 is spaced 60 mm away from the intersection of beam pairs F4-B4.

Ball movement direction is shown at an angle −U, relative to the intended direction.

The apparatus is operable to determine the ball movement direction and ball speed, after the ball has separated from the club face and commenced free flight, by calculation methods which commence with an accurate recording of the times at which the four beams are first interrupted.

Ball Direction

Similar to the determination of club movement direction, described earlier, the determination of ball movement direction relies on a recognition that the distance traveled by any point on the ball between the two parallel beams F4 and F6, or the two parallel beams B4 and B6, will varies with the relative angle of direction to the beam, becoming shorter as the club direction of motion becomes more closely aligned with the perpendicular to the beam and becoming longer as it becomes less closely aligned. Accordingly, since the two sets of parallel beams lie at different angles, the ratio of the distance traveled between them provides sufficient information to give a direct indication of the relative angle of direction of club motion.

Referring again to FIG. 5, this shows a ball, with its centre travelling along line AG, which lies at an angle of magnitude U to the intended direction. The ball is shown with its centre at positions D, E, F and G where it first interrupts beams F4, B4, F6 and B6, respectively. The initial point of interruption is where the beam lies as a tangent to the leading surface of the ball and the point of first contact can be found as the perpendicular from the centre of the ball to the beam. These first points of contact are at positions H, I, J and K on beams F4, B4, F6 and B6, respectively.

The ball may be reasonably assumed to remain at a constant speed and at a constant angle to its direction of motion as it first interrupts the four beams. Therefore the two time intervals which are recorded between F4 and F6, and between B4 and B6 being first interrupted will be in proportion to the distances HJ and IK, respectively. Therefore, measurement of these two time intervals will provide the ratio HJ/IK. These distances also relate to the relative positions of the ball, since HJ=DF and IK=EG.

The figure also shows lines HN and IM, both parallel to the intended direction, where N lies on beam F6 and M lies on beam B6.

It can be seen from the figure that IK>HJ and that the ball travels to the right. It will immediately be appreciated that IK=HJ where the ball travels straight and that IK<HJ where the ball travels to the left. It will also be appreciated that there is a unique value for the ratio HJ/IK for each direction of the ball and that knowledge of this value, from measurement of the appropriate beam first interruption time intervals, allows the direction of the ball to be determined.

The following trigonometric analysis provides a direct relationship between angle U and the ratio IK/HJ.

In triangle IKM, using the standard solution for an oblique triangle, IK/IM=sin(IMK)/sin(IKM). Length IM and angle (IMK) are known values. Also, angle (IMK)+angle (IKM)+angle (KIM)=180°, therefore angle (IKM)=([a known value]−U).

Therefore, IK=(a known value)/sin ([a known value]−U).

Similarly, in triangle HJN, HJ/HN=sin(HNJ)/sinV. Length HN and angle (HNJ) are known values. Also, as before, angle V=([a known value]−U). Therefore, HJ=(a known value)/sin ([a known value]−U).

Combining these, IK/HJ=(a known value)×sin([a known value]−U)/sin([a known value]-U).

The above analysis indicates that the ratio of the relative times, or differences in relative times, between changes in one parallel pair compared to another parallel pair has a fixed relationship to the angle of club face direction and angles of the beams.

Ball Speed

The speed of the ball, as projected in the horizontal plane, can be determined when the angle of ball movement, U, is determined, since this allows distances to be calculated between two recorded instances of the beams being first interrupted. The parallel pairs of beams provide the framework for this distance calculation, since the distance between them is a known characteristic of the apparatus.

Referring again to FIG. 5, perpendiculars HP and IQ are constructed from points H and I, respectively, onto beams F6 and B6, respectively. Angles HJP and IKQ are denominated as "V" and "W", respectively.

It can be seen from the figure that where the ball first interrupts beams F4 and F6 at H and J, respectively, the distance traveled is HJ. Since the distance HP between parallel beams is a known characteristic of the apparatus, HJ can therefore be calculated, since HJ=HP/sinV, and V is a known value. In triangle HJN, V+U+S=180° and U and S are both known values.

Similarly, it can be seen from the figure that where the ball first interrupts beams B4 and B6 at I and K, respectively, the distance traveled is IK. Since the distance IQ between parallel beams is a known characteristic of the apparatus, IK can therefore be calculated, since IK=IQ/sinW, and W is a known value. Angle IMK=180°−S. Therefore, in triangle IKM, W+U+[180°−S]=180°, i.e. W=S−U, and U and S are both known values. Both values for speed should be the same and an average may be taken if the results differ slightly.

Alternative Methods for Calculating Ball Direction and Speed.

FIG. 6 refers to an alternative method for measuring ball direction and speed. In this instance, the system records the first interruption and reinstatement of the beams and uses just one pair of beams, F6-B6.

Similar to the method, described earlier, the alternative determination of ball movement direction again relies on a recognition that the distance traveled will vary with the relative angle of direction to the beam, becoming shorter as the ball direction of motion becomes more closely aligned with the perpendicular to the beam and becoming longer as it becomes less closely aligned. The ratio of the distance traveled through the two beams at different angles will provide sufficient information to give a direct indication of the relative angle of direction of the ball.

Referring now to FIG. 6, this shows a ball, with its centre travelling along line AF, which lies at an angle of magnitude U to the intended direction. The ball is shown with its centre at positions C, D, E and F where it first interrupts F6, first interrupts B6, reinstates F6 and reinstates B6, respectively. The initial point of first interruption or reinstatement is where the beam lies as a tangent to the leading or trailing surface of the ball and the point of first contact can be found as the perpendicular from the centre of the ball to the beam. These first points of contact are at positions G, H, I and J on beams F6, B6, F6 and B6, respectively. The locus of the ball centre commences at A and crosses beams F6 and B6 at N and M, respectively. The locus of the ball centre also lies at angles Y and W to beams F6 and B6, respectively.

The ball may be reasonably assumed to remain at a constant speed and at a constant angle to its direction of motion as it first interrupts and reinstates the two beams. The following insight is an aspect of the invention. The angle of direction and the speed of the ball are capable of being calculated solely from knowledge of the periods between first interruption and reinstatement of the two beams. Where the periods are equal, the ball is travelling along the intended direction. Where the period is shorter across the F6 beam, the direction is to the right. Where the period is shorter across the B6 beam, the direction is to the left. The greater the difference in periods, the greater is the deviation from the intended direction.

The following trigonometric analysis provides a direct relationship between angle U and the ratio EN/DK. SinY=EH/EN. SinW=DI/DK. EH and DI are both known values, being the radius of the ball. The ratio EN/DK is also a known value, since it is equal to the ratio of the time intervals between beam F6 being first interrupted and reinstated and beam B6 being first interrupted and reinstated, since ball speed is constant and EN and DK each correspond to half the distance traveled in each time interval. Therefore, sinY/sinW=known value. From observation of triangle ABK, it can be seen that W+U+(180°−S)=180°, i.e. W=S−U. From observation of triangle CGN, it can be seen that Y=180°−S−U. Therefore, sin(180°−S−U)/sin(S−U)=known value. Since S is also a known value, angle U may be solved.

The analysis indicates that the ratio of the relative times, or differences in relative times, between changes in one beam compared to the other beam has a fixed relationship to the angle of club face direction and angles of the beams.

Once the direction of motion is known, it is possible to determine the speed, since the ball diameter is known. Referring again to FIG. 6, it can be seen that the distance traveled by the ball, as it first interrupts and then reinstates beam B6, is given by line DF. This distance exceeds the ball diameter by length LM. LM is found as follows. In triangle FJK, sinW=FJ/(FM+KM). Therefore, KM is a known value since FJ and FM are known values, each being equal to the radius of the ball. FJK and DIK are similar triangles, because FJ=DI, therefore KM=KL. Therefore the value for LM is known. Therefore the value for DF is known. The speed can then be calculated by dividing this distance by the time interval recorded where beam B6 was first interrupted and then reinstated.

A very similar exercise will yield the value for CE. The speed can similarly be calculated by dividing this distance by the time interval recorded where beam F6 was first interrupted and then reinstated. Both values for speed should be the same and an average may be taken if the results differ slightly.

The following comparisons may be made between the two ball movement measurement methods. The earlier described interrupt-only method provides the following potential advantages. Recording of time interval will not be distorted by variables which equally affect both signals since time intervals are determined between like interrupt signals. The distance over which the interval is measured is not confined to a dimension related to the diameter of the golf ball. The measurements are not dependant on prior knowledge of the golf ball diameter. The later described interrupt and reinstate method may provide the following potential advantages. It requires only one set of beams. It can also detect the trailing club face since the signal is always reinstated immediately after the ball has passed through it.

A second alternative method utilises the starting position of the ball as one of the reference points for the measurement of ball movement direction and ball speed. It can be similarly readily shown that the ratio of the relative times, or differences in relative times, between changes in one beam compared to the other beam has a fixed relationship to the angle of club face direction and angles of the beams. Similar to the first alternative method, it requires only one set of beams, but in this instance it does not have the disadvantage of being confined to a dimension related to the diameter of the golf ball. However, it has several relative disadvantages. These include a dependency on the accuracy or consistency of the ball starting position. They also include the necessity to measure or estimate the time of commencement of ball take-off from the starting position. They further include the necessity to accommodate the early period of movement of the ball when it is in contact with the club face, when the speed is constantly changing and the movement is not necessarily in a straight line.

It can be similarly readily shown that the ratio of the relative times, or differences in relative times, between changes in one beam compared to the other beam has a fixed relationship to the angle of club face direction and angles of the beams.

Position of the Ball Tracking Beams.

An important consideration, where the object being measured is being trailed by a second object, is that beam interruption or reinstatement is not affected by the trailing object. For example, where a golf ball is struck by a golf club, the necessary beam interruption or reinstatement signals measuring the ball must be completed before the club face interrupts the beams.

This will usually present no problem where the ball measurement signals are solely interruption signals, because the leading face of the ball is at least one ball diameter ahead of the contact region of the trailing club face and this is sufficient to ensure that the ball will interrupt all beams ahead of the club face.

However, this condition does not apply where the beams are required to be reinstated before being broken by the trailing club face. In this instance, a gap must be provided between the beams and the starting position of the ball. The minimum size of this gap can be estimated from consideration of the mechanics of a golf club hitting a golf ball. In a typical drive shot, the ball and club face remain in contact for about 11.5 mm. The club contacts the ball at about 30 m/s and gradually slows down to about 24 m/s during the contact period. The ball separates from the club face at about 52 m/s. Thus, after separation, the ball typically travels at slightly more than twice the speed of the club face.

In an idealised situation, where a perfect shot is taken with the club face central, square and travelling in the intended direction, the beam is set orthogonal to the intended direction, and the ball speed is twice the club face speed, the beam could be set just one ball diameter ahead of the ball at the point where the ball and club face separate. Where the ball diameter is 42 mm, the beam would be reinstated with a gap of 21 mm still remaining between it and the trailing club face.

However, in a real situation, accommodation must be made for the club face not being, central and square and for the beams not being orthogonal to the intended direction. Accommodation must also be made for a poorly hit shot where ball speed could fall well short of being twice club face speed. Overall, a gap of about 70-100 mm will usually suffice between the beams and the leading face of the ball prior to impact.

Vertical Height Considerations.

Up to this point, consideration has only been given to the determination of movement in the horizontal plane. However, both the club and ball have important components of movement in the vertical plane which must be accommodated by the method and apparatus.

One aspect of vertical movement relates to the measurement of movement in the horizontal plane. Where the club face is being tracked, it will usually be desired to detect a consistent straight edge, such as the most forward leading straight edge, close to the lower edge of the club face. Where the ball is being tracked, it will usually be required to detect the full diameter in the horizontal plane through the centre of the ball, and not a lesser diameter above or below this level. The preferred method for achieving this type of detection is to use a band-type beam, which comprises a substantially flat elongate band with a cross section where the width is far greater than the thickness. In the preferred arrangement, the width of the band is disposed vertically and may also be referred to as its height. The banded beam has sufficient vertical height such that the range of possible positions of the object to be detected will interrupt some point on the band. In general, the system is operable to detect a change in the status of the banded beam, typically in the form of a partial interruption by an object entering any point on the cross section or a reinstatement to a status existing prior to an interruption.

In the preferred arrangement, the face or width of the band beams are disposed orthogonally to the common or horizontal plane. This has several advantages, including the following. It translates the beam to a line when projected onto the common plane, thereby simplifying the recording of changes to the beam by objects interrupting it or reinstating it at different vertical heights and facilitating the measurement of the motion characteristics. It facilitates the positioning of numerous beams located in close proximity. It provides an acceptable common beam face angle for beams detecting a ball and a club striking the ball, where the club is primarily descending and the ball is primarily rising when being measured.

Whether disposed orthogonally to the common plane or otherwise, the beams in each set measuring a motion characteristic will comprise at least one component in a common plane, this being a longitudinal component of the beam Another aspect of vertical movement relates to the measurement of movement in the vertical plane. In this instance, the objective is to determine the vertical height component itself. Once again a banded-type beam may be used. However, in this instance the determination is concerned with measuring the height or degree to which the beam is interrupted. Typically it is detecting the lowest or highest point on the object, whereas the previous type is typically concerned with detecting the leading or trailing point on the object.

The two aspects of vertical movement may be detected by separate beams or by beams arranged to carry out both functions. In the preferred embodiment, beams carry out both functions. This has the advantage of reducing the number of beams, and thereby reducing the number of components with the potential to reduce cost and problems. Where separate beams are dedicated to the two functions, this has the potential to give the following relative advantages. The vertical beams can be a single beam orthogonal to the intended direction, rather than follow the angled pairs used for horizontal measurement. The vertical beams can also be ranged to detect the bottom or top of the ball, and the horizontal beams can be ranged to detect the centre leading or trailing edges of the ball, thus reducing the required vertical range for each. The horizontal beams can be arranged as simple yes-no detectors, with particular attention given to the accuracy of the yes-no switch. Under certain circumstances, vertical beams may be used where the same beam measures the top of low lofted balls and the bottom of high lofted balls.

A potential problem arises with band-type beams detecting vertical movement in a golf shot. This relates to the relatively steep loft of certain golf shots and to a lesser extent the steep downward swing of certain club movements. Where a simple band-type beam is used, a very high band is required unless the band is positioned close to the starting position of the ball. However, several potential disadvantages arise from positioning the band close to the starting position, including compromise of accuracy of horizontal movement and prevention of the use of beam reinstatement signals for horizontal movement for ball detection, due to interruption by the trailing club face.

In one embodiment of the present invention, at least one band-type beam is replaced by a plurality of bands. In an alternative embodiment, at least one band-type beam is inclined at an angle to the vertical, such that movement in a horizontal plane at a relatively lower loft is detected further from the initial ball position than movement in a horizontal plane at a relatively higher loft.

This provides several potential advantages, including the following. It may increase the horizontal distance between the beam and the initial ball position for low lofted shots, such as drive shots, thereby increasing accuracy of movement detection in the horizontal plane. This type of accuracy is of particular importance for low lofted shots. A second advantage is that it allows detection of highly lofted shots without requiring overly high band-type beams. A third potential advantage is that it reduces the maximum vertical height of the apparatus emitting and receiving the beams, thereby making it less prone to damage from errant golf swings and less visually distracting to the player.

In a preferred embodiment of the invention, an additional pair of beams is provided on the outgoing side, comprising two beams at reversed angles with their intersections lying on the line of the intended direction of movement of the ball, but spaced apart from the intersections of the other beams. The beams in this pair are parallel to the beams in the other outgoing pairs. An arrangement of this type is shown in FIG. 7, where F5 and F6 are the additional pair and its intersection is shown midway between the intersections of pair F4-B4 and pair F6-B6. All three pairs are active when a shot is taken, F4-B4 and F6-B6 cooperating to measure the movement characteristics of medium to low lofted balls and F4-B4 cooperating to measure the movement characteristics of high, medium and low lofted balls. Where a shot properly falls within the measurement range of the F6-B6 beam pair, the measurements from this pair are used to determine the movement characteristics. The second pair of beams also provides further information on the vertical height of the ball and the F6-B6 and F5-B-5 pairs are arranged such that ambiguity is avoided in the determination of ball vertical height.

Neural Means

The mathematical models, which have been discussed, treat the club face as a fixed width, straight line surface with sharply defined ends. In reality, the club face may not be perfectly flat and the edges will not be sharply defined. Also, although the mathematical models automatically deal with all specific club widths, in reality, the effective width of the flat club face may also vary slightly with inclination of the club face.

These variations from the simple mathematical model may be dealt with in various ways. One of these is to use more refined mathematical models to accommodate the variations. Another is to use an artificial neural-type intelligence means, which has been previously trained with information relating a wide range of beam signals to resulting motion characteristics of the club face and ball. By artificial neural-type intelligence means, henceforth referred to as neural means, is meant, determination or problem solving means, which operates in a manner which has similarities to human determination or problem solving. In particular, this type of determination of problem solving relates to previously learned experience from which a solution can be determined or interpolated when a new problem or situation arises.

Where a neural means is used, it will usually be advantageous to pre-process some or all of the primary beam signals before presenting them to the neural means and weigh their relative importance to particular types of outputs. This pre-processing stage may be carried out by conventional electronic processing methods and devices.

For example, on the incoming beams measuring the club face, club direction and club speed outputs in the horizontal plane are weighted closely to pre-processed signals related to durations, and differences in durations, between interruptions in sets of parallel beams relevant to the club face. Club face angle and offset in the horizontal plane are weighted closely to pre-processed signals related to differences in durations between the interruption of relevant angled beams and beams at reverse angles to them of equal magnitude, for beam sets which are at different relative angles to each other. Club face angle and offset are also weighted closely to the determined values of club direction and speed. Ball direction and ball speed outputs in the horizontal plane are weighted closely to pre-processed signals related to durations, and differences in durations, between interruptions in sets of parallel beams relevant to the ball. Where reinstatement signals are also used, the outputs are closely weighted to pre-processed signals related to durations and differences in durations between interruptions and reinstatements of individual beams relevant to the ball.

Apparatus.

FIGS. 8, 9 and 10 show a preferred embodiment of an apparatus suitable for determining the movement characteristics of a club face and ball in a golf shot, using a beam arrangement corresponding to that shown in FIG. 7.

Referring now to FIG. 8, this shows a diagrammatic plan view, including a depiction of the central collimated beams as dashed lines. The apparatus comprises a playing surface and a ball positioned directly on the surface, or on a support tee on the surface, prior to the shot being taken. The playing surface may comprise a durable artificial turf or polymer mat.

An emitter reflector, comprising an array of vertical focusing reflecting strips, is positioned along the side of the playing surface furthest from the player and a detection reflector, also comprising an array of vertical focusing reflecting strips is positioned along the side nearest to the player. These reflectors are laterally positioned sufficiently far from the paths of the club and ball to avoid being struck by any normal shot and also to minimise visual obtrusiveness. The vertical height is also minimised to avoid being struck and to minimise visual obtrusiveness. The reflectors are mounted on blocks which are supported by a common frame below the level of the playing surface to ensure that correct alignment is maintained between them. The player stands on a platform or mat to equalise his or her standing position with that of the playing surface.

Referring now to FIGS. 9 and 10, FIG. 9 shows a diagrammatic cut away plan view of the apparatus shown in FIG. 8, showing the arrangement beneath the playing surface, but retaining the views of the emitter reflector and detection reflector. The view includes a depiction of the beams as dashed lines. FIG. 10 shows a side sectional view on X-X of the apparatus shown in FIGS. 8 and 9. FIG. 10 depicts an arrangement where the ball is hit from an elevated tee-ed position, such as would typically occur in a drive shot.

Twelve emitters, one corresponding to each band beam required, are disposed along an emitter array block, which is located beneath the playing surface. The emitters comprise laser diodes and are orientated with their long axis in the vertical plane. Each emitter is provided with a lens, which will henceforth be referred to as the laser lens. Each emitter emits a beam which strongly diverges in the vertical plane. Each pair of emitter and lens is angled such that its beam is directed upwards towards the facets of a corresponding vertical reflecting strip on the emitter reflector, which is positioned above the level of the playing surface. The vertical plane, which contains the diverging beam, is approximately coincident with the vertical plane which contains the beam above the playing surface, but may vary slightly to allow for refraction effects at the reflector surface. The beam is reflected by the focusing reflector into a parallel collimated beam, as required by the arrangement shown in FIG. 7. The parallel collimated beam crosses the playing surface and falls on the facets of a corresponding reflective vertical strip on the detection reflector. The detection reflector focuses the parallel beam to a focal point at the entry window or a corresponding detector which is positioned below the playing surface. An array of twelve such detectors is mounted in a detector array block, each with its entry window positioned and directed at the focus of the corresponding incoming beam. The beams may cross through the plane of the playing surface either through polymer windows at the level of the playing surface, which are transparent to the signal radiation, or through openings at the level of the playing surface. Where openings are used, the emitters and detectors are protected from contamination by vertical or near vertical windows positioned between them and the openings.

It is important to ensure that the beam is well collimated into parallel rays across the main central region between the reflectors. It is also important that it should have an intensity distribution which varies as little as possible across the beam, or where intensity variation is inevitable, that it is minimised and occurs in a regular predictable manner.

Laser diodes are used as the emitter source and can be obtained at low cost with very small source sizes of about 0.001 mm, and divergences of about 30° by 8° FWHM (full width, half maximum). The laser diode is orientated such that the greater divergence axis is orientated to vertical to provide the vertical height of the beam and the smaller divergence axis is orientated to horizontal, to provide its thickness. The smaller divergence along the horizontal axis of the laser beam is almost fully collimated in a single stage in the laser lens, for example where an 8° divergence is emitted; this is reduced to less than 1°. The small degree of deliberately retained divergence provides an important and advantageous element in accommodating positional tolerance, which is described later. The larger divergence along the vertical axis is collimated in two stages. For the arrangement shown in the figures, a 30° divergence is inadequate to provide a trimmed beam of sufficient height to accommodate a full range of golf shots, and the laser lens increases the divergence to about 44-45° on the vertical axis. This vertically divergent beam falls on the facets of the emitter reflector where it is focused into a parallel collimated beam.

The radiation output from the laser diode follows a natural Gaussian distribution pattern across each axis, increasing in intensity towards the centre and decreasing towards the edges. This undesirable variation is worsened by the upward projection of the beam onto the vertical reflector, which, if not otherwise corrected, would tend to reduce the intensity from bottom to top in the central outgoing beam from the reflector. These variations are reduced using two principal methods. One method is to discard or screen out the weak edges of the beam, eliminating about 30% of total beam intensity. The second method is to modify the beam in the laser lens. Along its vertical and horizontal axes of magnification, the laser lens progressively stretches the radiation transmitted closest to its centre to reduce its intensity flux and progressively compresses it closest to its edges to increase its intensity flux. To a lesser degree, the laser lens additional progressively stretches and compresses radiation to compensate for the effects of upwards projection. Overall, a vertical beam intensity of better than ±20% can be fairly readily achieved.

An important consideration in the arrangement of the apparatus is the alignment of beams across the various optical components. The system must be able to accommodate the various factors which can cause misalignment, including manufacturing tolerances and changes arising from variations in temperature and humidity. The principle method for accommodating potential misalignment is to arrange the detector such that it only requires a small portion of the initially emitted beam, and to arrange for the beam to diverge across each stage, following which it is trimmed or over-accommodated at each stage to allow for potential local misalignment. In the preferred embodiment, the laser diode and lens are arranged to emit a diverging beam which attains a thickness of approximately 2 mm where it meets the emitter reflector. The facets on the emitter reflector are approximately 6 mm in width, providing adequate positional tolerance of 2 mm on each side. The reflector is arranged with facets which do not magnify across a horizontal axis such that they reflect the beam, which is approximately 2 mm in thickness, with the same degree of small divergence with which it left the laser lens. This divergence causes it to attain a thickness of approximately 10 mm by the time it crosses to the detection reflector. The facets on the detection reflector are about 6 mm in width and effectively reduce the incoming 10 mm wide beam to a 6 mm wide outgoing beam, provided misalignment between the two reflectors does not exceed 2 mm on either side. Where misalignment exceeds 2 mm, the outgoing beam will reduce its nominal thickness of 6 mm by that amount. For example, a misalignment of 5 mm between the emitter and detection reflectors will still result in a 3 mm wide beam being reflected towards the detector. The detection reflector is also arranged with facets which do not magnify across a horizontal axis such that they reflect the beam, which is up to approximately 6 mm in thickness, with the same continuing degree of small divergence. This cause it to attain a thickness of up to approximately 8 mm by the time it reaches the region of the detector. The detection means is provided with a screening means which comprises a narrow vertical slit positioned in front of the detector window. In the preferred embodiment this comprises a 1 mm wide slit positioned close to the front of the detector window. Where a ±1 mm positioning tolerance is allowed within the detection means, a 3 mm incoming beam will suffice from the detection reflector. As previously mentioned, this corresponds to a ±5 mm positioning tolerance between the emitter and detection reflectors, which is readily controlled with the proposed apparatus. Tolerance control in a vertical direction is effected in a similar manner, and is more easily achieved due to beam height being far greater than beam width.

It may be noted that the use of the proposed final screen of 1 mm in thickness, substantially reduces the thickness of the active portion of the beam to 1 mm along its entire length. This advantageously provides an active beam of minimal thickness and good edge definition.

The laser lens is a small complex optic, formed as an injection moulded polymer component. It is positioned in front of the laser output, being held in correct registration by an integrally moulded flange or fixing on the lens moulding. The lens can assume various forms, a typical arrangement having two faces, a first face in a cylindrical concave polynomial form and a second face in a cylindrical convex aspheric or toroidal form. Suitable polymer materials include cycloolefin polymer or cycloolefin copolymer which have low water absorption properties.

The reflectors may be manufactured as single component polymer injection mouldings, produced in a similar polymer material to the laser lens. The bodies of the reflectors run the full length of the emitter means and detection means. They advantageously comprise a flat surface facing the playing region of the apparatus, which assists in resisting fouling and can easily be wiped clean. Although not shown in the figures, the moulded reflectors are ribbed in conventional manner to provide rigidity with low material thickness. The reflecting surfaces of the reflector comprise a vertical strip array of horizontally disposed Fresnel-type focusing facets which direct and collimate the beam as required. A magnified sectional plan view of two of these vertical strip arrays is shown in FIG. 13. The strips and facets are approximately 6 mm wide. The facets on the detection reflector are about 1 mm in height and are substantially flat. The facets on the emitter reflector are about 1-2 mm in height and are substantially flat when viewed in a horizontal section, but are curved when viewed in a vertical section. The collimation requirement would require much smaller facet heights if flat reflectors were used. The curved profile allows larger facets to be used, which permit the component to be produced by low cost injection moulding. The detection reflector facets do not need to be curved and can be readily produced with a 1 mm height. The reflecting surfaces of the facets are created as an internal surface in the material. The facet is created by moulding a hollow at its rear side which is subsequently metallised to create the reflecting surface. This has the advantage that the quality of the reflecting surface is dictated by the polymer surface rather than the metal, which can suffer surface oxidation or scratching. An inexpensive metallising material such as aluminium can be used. The beam must enter and depart the surface of the polymer material when reflected by the facet and will refract where the beam enters or departs at an angle which is not orthogonal. The angle of direction of the facets and the angle of the incoming beam from the laser lens or the outgoing beam to the detector are appropriately arranged to accommodate such refraction effects. The reflectors are produced as low-cost interchangeable components which can be readily mounted or removed from the apparatus. The figures show a merely diagrammatic mounting arrangement which comprises slots in the emitter and deflection means base. Actual mounting methods ensure that the reflector is secured along its length and stands orthogonal to the playing surface. In an alternative embodiment of this aspect of the invention, the reflectors are replaced by equivalent focusing lenses.

The laser diode has an output of approximately 1 mW and emits radiation at near infrared wavelengths between 780 nm and 1000 nm. Its divergence is typically 30° by 80° FWHM. The detector is a photodiode with a filter which blocks visible light. Its inlet window is approximately 2.5×2.5 or greater. It produces an electronic output which is proportional to the amount of relevant radiation entering its window. The laser diodes and photodiodes are pulse modulated in matched pairs such that stray signals from any emitter will not be registered by any unmatched detector. Modulation also prevents unwanted ambient radiation being registered by the detectors. Modulation is achieved by matched electronic drive to the laser diode and photodiode.

The emitter array block comprises a precision polymer injection moulding which holds the laser diodes and laser lenses in correct registration. The detector array block similarly comprises a precision polymer injection moulding which holds the photodiodes in correct registration. The detector array block may also advantageously comprise the detector screening means, with screening slots formed directly in the moulding. The use of black polymer material will assist screening. The screening means is depicted on an exaggerated scale in FIGS. 10-12 and, in reality, is positioned closer to the photodiode window. The emitter array block and emitter reflector are mounted on the common emitter means base. The detector array block and detection reflector are both similarly mounted on the common detection means base. The emitter means base and detection means base are held in mutual register by a base or frame which spans the width of the apparatus.

The arrangement, whereby the beam is reflected from or to emitters and detectors below the level of the playing surface, provides various advantages including the following. First, the use of interchangeable reflectors allows the use of different height emitter means and detection means for different types of shots, thereby reducing height obtrusiveness only to that which is required. Second, the use of interchangeable reflectors allows the emitter means or detection means closest to the player to be altered in relation to its position between the player and the ball, as required by different types of shots. Third, it keeps all components, other than reflectors, away from the playing area. This has several advantages. The reflectors are slim, largely transparent components which are relatively unobtrusive. They are also of low weight and arranged to readily dislodge if struck by a club, thereby eliminating fear of damage or injury should they be accidentally struck. The reflectors are produced as low cost replaceable components which can be readily and inexpensively replaced if accidentally damaged.

Referring now to FIG. 10, this depicts an arrangement suitable for drive shots where the ball is placed on a tee which elevates it up to about 30 mm above the playing surface. The view shows the height of the highest required reflector strip for an arrangement which will measure club and ball movement across a full range of normal shots. Optionally, the reflector components may retain this height along their length, or they may be produced with their upper edge varying in height as required by the heights of the individual reflector strips. The reflectors shown in FIG. 10 will also adequately measure club and ball movement across a wide range of ground shots, that is shots which are not elevated on a tee. Fortuitously, the additional reflector height required by the ball being elevated on the tee for a drive shot, is matched by the additional height required for ground shots where the ball may be more highly lofted and where the club can describe a much steeper downward approach to the ball. Thus one set of reflectors can be used for all of these shots, which includes almost all shots other than putting shots. An example of required reflector heights for an apparatus which will measure all ground shots and all drive shots, tee-ed up to 30 mm above the playing surface, where the arrangement is similar to that depicted in the figures, is given by the following. The F6-B6 and F5-B5 reflector strips are approximately 75 mm high; the F4-B4, F3-B3 and F2-B2 reflector strips are approximately 40 mm high and the F1-B1 reflector strips are approximately 80 mm high. Where the ball is tee-ed higher than 30 mm above the playing surface, correspondingly higher reflector strips are used. The laser diode beam is arranged of sufficient size to cover all reflector heights and is not altered when reflectors are changed.

Referring now to FIG. 11, this depicts an arrangement suitable for putting shots. Putting shots differ from other golf shots in that the player will usually stand much closer to the ball and club head speed is relatively slow. To accommodate these shots, the apparatus is accordingly provided with a second detection reflector position closer to the ball. Much lower reflector heights are required for putting shots and an example is given by the following. The F6-B6, F5-B5 and F4-B4 reflector strips are approximately 25 mm high; the F3-B3 and F2-B2 reflector strips are approximately 40 mm high and the F1-B1 reflector strips are approximately 50 mm high.

Referring now to FIG. 12, this shows an arrangement similar to FIG. 10, but where the emitter means and detection means are arranged to reduce the required height of the detection reflector by increasing the height of the emitter reflector. The facets on the emitter reflector are arranged to cause the beam to converge towards the detection reflector. The advantage of this system is that it reduces the required height of the reflector which stands between the player and the ball, thereby reducing its potential obtrusiveness. This advantage may be balanced against the disadvantages of higher emitter reflectors and more complicated computation in the measurement means, due to the more elaborate geometric arrangement of the converging beams.

The measuring means of the apparatus includes a programmed electronic processor which is operable to convert signals from the beams to movement characteristics of the club and ball, generally in line with the methods which have already been described. It may comprise an artificial neural-type intelligence means, as already discussed. Beam signals are detected in two principal modes. One of these modes is the recorded time of the initial interruption of the beam. The initial interruption is achieved using an analogue trigger, such as a Schmitt trigger, which activates when the voltage output from a photodiode falls by a small preset amount below its steady state level. The use of an analogue trigger provides a far higher level of accuracy than can be provided by conventionally converted digital signals. The time of initial interruption is used to determine the movement characteristics projected in the horizontal plane. The second mode of detection is the measurement of the degree to which the beam is obscured as the club or ball pass through it, and the subsequent determination of the vertical height of the bottom of the club or ball. This is achieved by using high speed electronic methods to track the output signal from the photodiode and record its lowest value. This lowest value is compared to the steady state signal which was present before the beam was interrupted. The comparison is converted to vertical height using a pre-programmed set of conversion values stored in the processor memory.

In an alternative preferred embodiment of the invention, which shall be referred to as the second preferred embodiment, the apparatus differs from the first preferred embodiment in the following ways. The emitter means and detection means are disposed on the same side of the apparatus, preferably on the side opposite the player. The emitted beam crosses the playing surface and is reflected back along the same path to be received by the detection means. A common reflection means, comprising a plurality of vertical arrays of reflecting facets, carries out the two tasks of directing the diverging rays from the emitters and lenses to the main operating beams and focusing the returning beams into converging rays which fall on the windows of the detectors. Although each vertical array of facets is shared by an emitter and a detector, the arrangement is otherwise similar to that of the first preferred embodiment. An additional reflection means is positioned on the other side of the apparatus. It is of similar overall dimensions to the detection reflection means of the first preferred embodiment, being sufficiently large to intercept the set of emitted beams. It comprises a retroreflective surface which, in a preferred variant, has closely packed arrays of optical corner cubes which reflect any beam of light accurately back towards the source. The corner cubes have three reflective faces at 90 degrees to each other. The orientation of the retroreflector is very uncritical. The retroflective reflector may be produced at low unit cost as a polymer injection moulding. The arrangement requires the detected beam to be separated from the optical path of the emitted beam. This may be achieved by interposing an obliquely angled semi reflective mirror, typically about 50% reflective, in the path of the emitted beam, between the laser lens and the reflector means. Approximately half of the returning beam is reflected away from the optical path of the emitter towards the detector, which is positioned at the appropriate focal point of the reflected portion. The components of the emitter means and detection means may advantageously be mounted on a common array block and base which can greatly assist positional registration between the components.

The second preferred embodiment has several disadvantages relative to the first preferred embodiment, including the following. Up to about 75% of the power of the beam may be lost at the semi reflective mirror, thereby necessitating higher powered emitters to provide equal signal strength at the detector. The portion of the beam above the playing surface is doubled in length, thereby increasing the extent of unwanted internal divergence within the beam.

The second preferred embodiment also has several advantages relative to the first preferred embodiment, including the following. Positional alignment between the emitter means and detection means is better assured by the relatively uncritical positional tolerance of the retroflective reflector and by the close location on a common base of the emitter means and detection means. The same retroreflective reflector may also be used at different distances from the starting position of the ball, where changes in distance may suit different types of shots or different players. The grouping together of the emitter and detection components also allows the apparatus to be manufactured at lower cost and in a manner which may facilitate ready assembly and disassembly of components of the apparatus to facilitate packaging, storage and transport.

In a further alternative embodiment of the invention, the array of twelve emitters is replaced with one common emitter, or two common modulated emitters. The emitters are positioned on the detection means side of the apparatus, beyond the detection point of the final F6-B6 beams, and optionally above the level of the playing surface. The emitters emit radiation towards the emitter reflector, which is located similar to that shown in FIG. 8. Preferably, the common emitters and the detection means are located on the side of the apparatus opposite the player. The facets on the reflective strips on the reflector are arranged such that they redirect radiation back towards the detection reflector in geometric directions similar to that shown in FIG. 8. The beam signals are detected in a similar manner as described for the first preferred embodiment. The commencing radiation from the emitters may be focused by lenses to preferentially direct the radiation onto the reflecting strips and closely surrounding regions of the emitter reflector.

It is to be understood that the invention is not limited to the specific details described herein, and that various modifications and alterations are possible without departing from the scope of the invention as defined in the appended method and apparatus claims.

The invention claimed is:

1. A method of measuring or determining movement characteristics of items selected from a group comprising an object and an object and a ball, by detection of changes in one or more sets of at least three cooperating banded beams disposed in the movement path of the items, characterized by:

providing three banded beams, from emitter radiation sources, that are configured with respective cross sections whose elongated widths of radiation are substantially greater than an orthogonal thickness of each banded beam, wherein changes are detectable when an object disrupts, reinstates, or partly obscures a banded beam;

selecting the object from a group comprising an edge, a projected edge, and the face of an implement used to strike a ball, wherein the object further comprises two corners, or ends, which are to be detected or measured;

the three banded beams are aligned in the movement path of the items to enable at least one corner, or end, to sequentially change at least two banded beams in a set; and at least three banded beams in a set are sequentially changed by the movement of the object, wherein separate detection or measurement is made of each corner, or end, as it changes a banded beam in a set and reflected radiation from the banded beams are returnable along the same path of reflection;

detection or measurement of the object occurs with a radiation detector, when the object retains movement characteristics relevant to impact with a ball, so as to measure movement characteristics of the items; and outputting the measurements of the items.

2. A method according to claim 1, wherein a record or measurement is made of the times, durations or differences in times or differences in durations at which different banded beams of a set are changed.

3. A method according to claim 1, which has one or more features selected from a group comprising one where:

banded beams are disposed at acute angles to the intended direction of the object or ball;

at least one longitudinal component of each banded beam in a set, lies in a common plane;

at least one longitudinal component of each banded beam in a set, lies in a common plane and at least one longitudinal component of each banded beam in a set, lies in a common plane and the common plane is substantially horizontal;

one banded beam of a set is disposed at an acute angle clockwise to the intended direction of the object or ball and another banded beam of the set is disposed at an acute angle counter clockwise to the intended direction of the object or ball;

one banded beam of a set is disposed at an acute angle clockwise to the intended direction of the object or ball and another banded beam of the set is disposed at an acute angle counter clockwise to the intended direction of the object or ball and the magnitude of the acute angles is equal; and one banded beam of a set is disposed at an acute angle clockwise to the intended direction of the object or ball and another banded beam of the set is disposed at an acute angle counter clockwise to the intended direction of the object or ball and the magnitude of the acute angles is equal and two banded beams of a set intersect at a point along the line of the intended direction of the object or ball.

4. A method according to claim 1, wherein the edge, or projected edge, is orthogonal or near orthogonal to the intended direction of the object or ball, and which has one or more features selected from a group comprising:

the edge or projected edge is a leading edge and is substantially a straight line or slightly curved line;

the banded beams of a set are disposed at acute angles to the intended direction of the object or ball, of magnitude greater than the angle subtended between the edge and the intended direction of the object or ball;

the angles of the banded beams, relative to the intended direction of the object or ball, exceed the maximum range of the angle of the edge, relative to the intended direction of the object or ball, over which measurement is made;

the banded beams of a set are disposed at acute angles to the intended direction of the object or ball, of magnitude greater than the angle subtended between the edge and the intended direction of the object or ball, and one of the movement characteristics of the object is its direction of movement relative to the intended direction of the object; the banded beams of a set comprise at least two pairs of parallel banded beams, with one pair disposed at a relative angle to the other pair, and the resulting measurement being associated with a determination of the ratio of the relative times, or differences in relative times, between changes in one parallel pair compared to another parallel pair;

the banded beams of a set are disposed at acute angles to the intended direction of the object or ball, of magnitude greater than the angle subtended between the edge and the intended direction of the object or ball, and one of the movement characteristics of the object is its direction of movement relative to the intended direction of the object; the banded beams of a set comprises at least two pairs of parallel banded beams, with one pair disposed at a relative angle to the other pair; and the resulting measurement being associated with a determination of the ratio of the relative times, or differences in relative times, between changes in one parallel pair compared to another parallel pair, and the ratio of the relative times, or differences in relative times, between changes in one parallel pair compared to another parallel pair has a fixed relationship to the angle of direction of movement of the object and angles of the banded beams;

the banded beams of a set are disposed at acute angles to the intended direction of the object or ball, of magnitude greater than the angle subtended between the edge and the intended direction of the object or ball, and one of the movement characteristics of the object is its direction of movement relative to the intended direction of the object; the banded beams of a set comprises at least two pairs of parallel banded beams, with one pair disposed at a relative angle to the other pair; and the resulting measurement being associated with a determination of the ratio of the relative times, or differences in relative times, between changes in one parallel pair compared to another parallel pair, and a second of the movement characteristics is the speed of movement of the edge; speed is determined as distance divided by time, with time determined by the duration between one corner, or one end, of the object effecting successive changes in two parallel banded beams of one of the pairs of banded beams, and distance determined by application of the determined direction of movement to the distance between the parallel banded beams;

the banded beams of a set are disposed at acute angles to the intended direction of the object or ball, of magnitude greater than the angle subtended between the edge and the intended direction of the object or ball, and one of the movement characteristics of the object is its direction of movement relative to the intended direction of the object;

the banded beams of a set comprises at least two pairs of parallel banded beams, with one pair disposed at a relative angle to the other pair;

the resulting measurement being associated with a determination of the ratio of the relative times, or differences in relative times, between changes in one parallel pair compared to another parallel pair, and the intersections of the banded beams of a set disposed at relative angles to each other both intersect at points along the line of the intended direction of the object or ball;

the banded beams of a set are disposed at acute angles to the intended direction of the object or ball, of magnitude greater than the angle subtended between the edge and the intended direction of the object or ball, and another of the movement characteristics is the angle of the edge relative to the intended direction of the object or ball;

the banded beams of a set comprise one pair of beams disposed in one rotation at different acute angles to the intended direction of the object or ball and a second pair of banded beams disposed in the opposite rotation at different acute angles to the intended direction of the object or ball;

wherein the measurement is associated with the angle of the edge being indicated closer to the angle of banded beams which are changed later and being indicated further from the angle of banded beams which are changed sooner;

an increased difference between relative changes between banded beams of opposite rotation indicating the movement characteristic to be predominantly angle rather than offset;

a reduced difference between relative changes between banded beams of the same rotation indicating the movement characteristic to be predominantly offset rather than angle;

the banded beams of a set are disposed at acute angles to the intended direction of the object or ball, of magnitude greater than the angle subtended between the edge and the intended direction of the object or ball, and another of the movement characteristics is the angle of the edge relative to the intended direction of the object or ball;

the banded beams of a set comprise two banded beams disposed in one rotation at different acute angles to the intended direction of the object or ball and a third banded beam disposed in the opposite rotation at an acute angle to the intended direction of the object or ball;

where the measurement is associated with the angle of the edge being indicated closer to the angle of banded beams which are changed later and being indicated further from the angle of banded beams which are changed sooner;

an increased difference between relative changes between banded beams of opposite rotation indicating the movement characteristic to be predominantly angle rather than offset;

a reduced difference between relative changes between banded beams disposed in the same rotation, indicating the movement characteristic to be predominantly offset rather than angle;

the banded beams of a set are disposed at acute angles to the intended direction of the object or ball, of magnitude greater than the angle subtended between the edge and the intended direction of the object or ball, and another of the movement characteristics is the offset of the edge, or offset of the effective centre of the edge, relative to its intended direction or intended position;

the banded beams of a set comprise one pair of banded beams disposed in one rotation at different acute angles to the intended direction of the object or ball and a second pair of banded beams disposed in the opposite rotation at different acute angle clockwise to the intended direction of the object or ball;

the measurement is associated with the offset of the edge being indicated closer to the region comprising the most forward banded beam which is changed sooner and being indicated further from the region comprising a banded beam which is changed later; and a reduced difference between relative changes between banded beams which are disposed in the same rotation, indicating the movement characteristic to be progressively offset rather than angle an increased difference between relative changes between banded beams disposed in the opposite rotation indicating the movement characteristic to be progressively angle rather than offset;

the banded beams of a set are disposed at acute angles to the intended direction of the object or ball, of magnitude greater than the angle subtended between the edge and the intended direction of the object or ball, and another of the movement characteristics is the offset of the edge, or offset of the effective centre of the edge, relative to the intended direction or intended position;

the banded beams of a set comprise two banded beams disposed in one rotation at different acute angles to the intended direction of the object or ball and a third banded beam disposed in the opposite rotation at an acute angle clockwise to the intended direction of the object or ball;

the measurement is associated with the offset of the edge being indicated closer to the region comprising the most forward banded beam which is changed sooner and being indicated further from the region comprising a banded beam which is changed later;

a reduced difference between relative changes between banded beams which are disposed in the same rotation, indicating the movement characteristic to be progressively offset rather than angle;

an increased difference between relative changes between banded beams disposed in the opposite rotation indicating the movement characteristic to be progressively angle rather than offset;

the banded beams of a set are disposed at acute angles to the intended direction of the object or ball, of magnitude greater than the angle subtended between the edge and the intended direction of the object or ball, and the intersections of the banded beams of a set are coincident and lie at a point on the line of the intended direction;

the banded beams of a set are disposed at acute angles to the intended direction of the object or ball, of magnitude greater than the angle subtended between the edge and the intended direction of the object or ball, and the magnitudes of angles of the opposite rotation are equal;

the banded beams of a set are disposed at acute angles to the intended direction of the object or ball, of magnitude greater than the angle subtended between the edge and the intended direction of the object or ball; and the difference in angle between cooperating banded beams which are disposed at different angles is between 5° and 20°;

the banded beams of a set are disposed at acute angles to the intended direction of the object or ball, of magnitude greater than the angle subtended between the edge and the intended direction of the object or ball;

the difference in angle between cooperating banded beams which are disposed at different angles is approximately 10°;

the banded beams of a set are disposed at acute angles to the intended direction of the object or ball, of magnitude greater than the angle subtended between the edge and the intended direction of the object or ball, and one of the movement characteristics of the object is its direction of movement relative to the intended direction of the object;

the banded beams of a set comprises at least two pairs of parallel banded beams, with one pair disposed at a relative angle to the other pair;

the resulting measurement being associated with a determination of the ratio of the relative times, or differences in relative times, between changes in one parallel pair compared to another parallel pair; and the angle of cooperating banded beams which are parallel to each other is between 65° and 80°;

the banded beams of a set are disposed at acute angles to the intended direction of the object or ball, of magnitude greater than the angle subtended between the edge and the intended direction of the object or ball, and one of the movement characteristics of the object is its direction of movement relative to the intended direction of the object;

the banded beams of a set comprises at least two pairs of parallel banded beams, with one pair disposed at a relative angle to the other pair;

the resulting measurement being associated with a determination of the ratio of the relative times, or differences in relative times, between changes in one parallel pair compared to another parallel pair and the angle of cooperating banded beams which are parallel to each other is approximately 75°;

the banded beams of a set are disposed at acute angles to the intended direction of the object or ball, of magnitude greater than the angle subtended between the edge and the intended direction of the object or ball, and one of the movement characteristics of the object is its direction of movement relative to the intended direction of the object;

the banded beams of a set comprises at least two pairs of parallel banded beams, with one pair disposed at a relative angle to the other pair;

the resulting measurement being associated with a determination of the ratio of the relative times, or differences in relative times, between changes in one parallel pair compared to another parallel pair;

the distance between intersections between parallel pairs of cooperating banded beams is between 40 mm and 70 mm;

the banded beams of a set are disposed at acute angles to the intended direction of the object or ball, of magnitude greater than the angle subtended between the edge and the intended direction of the object or ball, and one of the movement characteristics of the object is its direction of movement relative to the intended direction of the object;

the banded beams of a set comprises at least two pairs of parallel banded beams, with one pair disposed at a relative angle to the other pair;

the resulting measurement being associated with a determination of the ratio of the relative times, or differences in relative times, between changes in one parallel pair compared to another parallel pair; and the distance between intersections between parallel pairs of cooperating banded beams is 50-60 mm.

5. A method according to claim 1, which measures or determines movement characteristics of a ball struck by the implement and which has one or more features selected from a group comprising:

one of the movement characteristics is the direction of movement of the ball relative to the intended direction of the ball;

the banded beams of a set comprise at least two pairs of parallel banded beams, with one pair disposed at a relative angle to the other pair; the measurement being associated with a determination of the ratio of the relative times, or differences in relative times, between changes in one parallel pair compared to another parallel pair;

one of the movement characteristics is the direction of movement of the ball relative to the intended direction of the ball;

the banded beams of a set comprise at least two pairs of parallel banded beams, with one pair disposed at a relative angle to the other pair;

the measurement being associated with a determination of the ratio of the relative times, or differences in relative times, between changes in one parallel pair compared to another parallel pair;

the ratio of the relative times, or differences in relative times, between changes in one parallel pair compared to another parallel pair has a fixed relationship to the angle of ball direction and angles of the banded beams;

one of the movement characteristics is the speed of movement of the ball;

speed is determined as distance divided by time, with time determined by the duration between the ball effecting changes on two parallel banded beams of one of the pairs of banded beams, and distance determined by application of the determined direction of movement to the distance between the parallel banded beams;

the intersections of the banded beams of a set disposed at relative angles to each other both intersect at points along the line of the intended direction of the ball;

one of the movement characteristic is the direction of movement of the ball relative to the intended direction of the ball where the banded beams of a set comprise at least two banded beams, with one banded beam disposed at a relative angle to the other banded beam;

a change is recorded when the ball first disrupts a banded beam of the set and a change is recorded when the banded beam is reinstated when the ball passes through it;

the measurement being associated with a determination of the ratio of the relative times, or differences in relative times, between changes in one banded beam compared to the other banded beam;

one of the movement characteristic is the direction of movement of the ball relative to the intended direction of the ball where the beams of a set comprise at least two banded beams, with one banded beam disposed at a relative angle to the other banded beam; and a change is recorded when the ball first disrupts a banded beam of the set and a change is recorded when the banded beam is reinstated when the ball passes through it;

the measurement being associated with a determination of the ratio of the relative times, or differences in relative times, between changes in one banded beam compared to the other banded beam;

the ratio of the relative times, or differences in relative times, between changes in one banded beam compared to the other banded beam has a fixed relationship to the angle of ball direction and angles of the banded beams;

one of the movement characteristic is the speed of movement of the ball;

speed is determined as distance divided by time, with time determined by the duration between the ball effecting disruption and reinstatement changes on one of the banded beams, and distance determined by application of the determined direction of movement to the known geometry of the ball and banded beam;

one of the movement characteristics is the direction of movement of the ball relative to the intended direction of the ball;

where the banded beams of a set comprise at least two banded beams, with one banded beam disposed at a relative angle to the other banded beam;

the ball commences or continues motion from a known position and at a known time;

the measurement being associated with a determination of the ratio of the relative times, or differences in relative times, between changes in the banded beams of a set and the time the ball commenced or continued motion from the known position;

one of the movement characteristics is the direction of movement of the ball relative to the intended direction of the ball;

where the banded beams of a set comprise at least two banded beams, with one banded beam disposed at a relative angle to the other banded beam;

the ball commences or continues motion from a known position and at a known time;

the measurement being associated with a determination of the ratio of the relative times, or differences in relative times, between changes in the banded beams of a set and the time the ball commenced or continued motion from the known position;

the ratio of the relative times, or differences in relative times, between changes in one beam compared to the other banded beam has a fixed relationship to the angle of ball direction and angles of the banded beams;

one of the movement characteristics is the speed of movement of the ball;

speed is determined as distance divided by time, with time determined by the duration between the ball effecting a change in one of the banded beams, and distance determined by application of the determined direction of movement to the known distance between the banded beam and the known position; and the ball commences or continues motion from a known position and at a known time; and the known position lies along the line of the intended direction of the ball.

6. A method according to claim 1, wherein the banded beams comprise substantially flat elongate bands with a cross section where the width is far greater than the thickness, and where the beam is selected from a group comprising:

the banded beam has a thickness of 0.5 mm to 2 mm;

the banded beam has a thickness of approximately 1 mm;

the banded beam has a cross section with a width which is orthogonal to the common plane;

a change is deemed to be an alteration to the banded beam, caused by the object or ball entering any point on the cross section of the beam and partly obscuring it;

a change is deemed to be an alteration to the banded beam, caused by the object or ball departing the beam and ceasing to partly obscure it;

the banded beam is measured as the object or ball passes through it;

a record is made of the maximum measured degree to which the banded beam is obscured;

a determination is made of the position of an edge of the object or ball relative to the width of the cross section of the banded beam using the record made of the maximum degree to which the banded beam is obscured;

two sets of banded beams are used to determine a movement characteristic of the object or ball;

one set operates over a shorter length along the direction of travel of the object or ball than the other, but covers a wider range of angular variation in the plane which comprises the width of the cross section of the banded beam;

the transmitted thickness of the cross section of the banded beam is significantly greater than that which is required for measurement;

the banded beam is such that measurement can be taken at a plurality of positions across the transmitted thickness of the cross section;

measurement is made using a cross section with a small dimension which is significantly less than the transmitted cross section; and the measured thickness of the cross section of the banded beam is determined by screening the transmitted beam on the receiving side of the banded beam.

7. A method according to claim 1, wherein a selection is made from a group comprising:

the banded beams are electromagnetic wave beams;

adjacent banded beams are pulsed and measured at different frequencies; and measurement is made using artificial neural-type intelligence.

8. A method according to claim 1, wherein a selection is made from a group comprising:

the implement is a golf club; and the ball is struck by the implement from a known or rest position.

9. Apparatus for measuring or determining the movement characteristics of items selected from a group comprising:

an object, and an object and a ball, by detection of changes in one or more sets of at least three cooperating beams disposed in the movement path of the items, the apparatus including beam generating means, a measurement means which includes a detection means and a computing means, the computing means is operatively connected to the detection means;

the beam generating means dispose beams in the path of the object or ball;

the detection means detects changes in the beams;

characterized by:

the beam generating means provides at least three banded beams from radiation emitters, that are configured with respective cross sections whose elongated widths of radiation are substantially greater than an orthogonal thickness of each banded beam;

the measurement means is operable to detect or measure an object which is an edge or projected edge of the face of an implement used to strike a ball, wherein changes are detectable when an object disrupts, reinstates, partly obscures or ceases to obscure a banded beam;

the measurement means is operable to detect or measure an object which comprises two corners or ends, which are detected or measured;

the detection means is operable to detect sequential changing of at least two banded beams in a set by a corner or end;

the detection means is operable to detect sequential changing of at least three banded beams in a set;

the detection means is operable to separately detect each corner or end by changes in banded beams in a set; and a reflecting means operable to return incident banded beams along the same path wherein the reflecting means and the detection means are located on the same side of the apparatus so as to measure the movement characteristics of the items .

10. An apparatus according to claim 9, wherein the measurement means is operable to record or measure the times or durations or differences in times or differences in durations, between changes in banded beams of a set; and to associate the resulting records or measurements with the movement characteristics of the object or ball.

11. An apparatus according to claim 9, which has features selected from a group comprising one where:

the banded beam generating means is operable to dispose the banded beams at acute angles to the intended direction of the object;

the banded beam generating means includes at least three banded beam generating means and at least three banded beam detection means;

the banded beam generating means is operable to dispose the banded beams at acute angles to the intended direction of the object;

there are at least three banded beam detection means, each of which is operable to detect a banded beam;

the banded beam generating means is operable to dispose longitudinal elements of at least two banded beams of a set in a common plane;

the banded beam generating means is operable to dispose longitudinal elements of at least two banded beams of a set in a common plane, the common plane is substantially horizontal;

the banded beam generating means disposes one banded beam of a set at an acute angle clockwise to the intended direction and disposes another banded beam of the set at an acute angle counter clockwise to the intended direction of the object or ball;

the banded beam generating means disposes one banded beam of a set at an acute angle clockwise to the intended direction and disposes another banded beam of the set at an acute angle counter clockwise to the intended direction of the object or ball, and the magnitude of the acute angles is equal; and the banded beam generating means disposes two beams of a set such that they intersect at a point along the line of the intended direction of the object or ball.

12. An apparatus according to claims 9, wherein measurement means is operable to detect or measure an object which is an edge, or projected edge, which is orthogonal or near orthogonal to the intended direction of the object or ball, and which has features selected from a group comprising:

the edge or projected edge is the leading edge of the face of the object and is substantially a straight line or slightly curved line;

the banded beam generating means disposes the banded beams at acute angles to the intended direction of the object, of magnitude greater than the angle subtended between the edge and the intended direction of the object or ball;

the angles of the banded beams, relative to the intended direction of the object or ball, exceed the maximum range of the angle of the edge, relative to the intended direction, over which measurement is made;

the banded beam generating means generates banded beams of a set which comprise at least two pairs of parallel banded beams, with one pair disposed at a relative angle to the other pair;

the measurement means is operable to measure the direction of movement of an edge relative to the intended direction; by determinations associated with the ratio of the relative times, or differences in relative times, between changes in one parallel pair compared to another parallel pair;

the banded beam generating means generates banded beams of a set which comprise at least two pairs of parallel beams, with one pair disposed at a relative angle to the other pair;

the measurement means is operable to measure the direction of movement of an edge relative to the intended direction;

by determinations associated with the ratio of the relative times, or differences in relative times, between changes in one parallel pair compared to another parallel pair;

the ratio of the relative times, or differences in relative times, between changes in one parallel pair compared to another parallel pair has a fixed relationship to the angle of club face direction and angles of the banded beams;

the beam generating means generates banded beams of a set which comprise at least two pairs of parallel banded beams, with one pair disposed at a relative angle to the other pair;

the measurement means is operable to measure the direction of movement of an edge relative to the intended direction;

by determinations associated with the ratio of the relative times, or differences in relative times, between changes in one parallel pair compared to another parallel pair;

the measurement means is operable to measure the speed of movement of the edge;

by determining speed as distance divided by time, with time determined by the duration between one corner, or end, of the edge effecting successive changes on two parallel banded beams of one of the pairs of beams, and distance determined by application of the determined direction of movement to the known distance between the parallel banded beams;

the banded beam generating means disposes the banded beams at acute angles to the intended direction of the object, of magnitude greater than the angle subtended between the edge and the intended direction of the object or ball;

the difference in angle between cooperating banded beams which are disposed at different angles is between 5° and 20°;

the banded beam generating means disposes the beams at acute angles to the intended direction of the object, of magnitude greater than the angle subtended between the edge and the intended direction of the object or ball;

the difference in angle between cooperating beams which are disposed at different angles is approximately 10°;

the banded beam generating means generates banded beams of a set which comprise at least two pairs of parallel banded beams, with one pair disposed at a relative angle to the other pair;

the measurement means is operable to measure the direction of movement of an edge relative to the intended direction;

by determinations associated with the ratio of the relative times, or differences in relative times, between changes in one parallel pair compared to another parallel pair;

the angle of cooperating beams which are parallel to each other is between 65° and 80°;

the banded beam generating means generates banded beams of a set which comprise at least two pairs of parallel banded beams, with one pair disposed at a relative angle to the other pair;

the measurement means is operable to measure the direction of movement of an edge relative to the intended direction;

by determinations associated with the ratio of the relative times, or differences in relative times, between changes in one parallel pair compared to another parallel pair;

the angle of cooperating beams which are parallel to each other is approximately 75°;

the banded beam generating means generates banded beams of a set which comprise at least two pairs of parallel banded beams, with one pair disposed at a relative angle to the other pair;

the measurement means is operable to measure the direction of movement of an edge relative to the intended direction;

by determinations associated with the ratio of the relative times, or differences in relative times, between changes in one parallel pair compared to another parallel pair;

the measurement means is operable to measure the speed of movement of the edge;

the distance between intersections between parallel pairs of cooperating banded beams is between 40 mm and 70 mm;

the banded beam generating means generates banded beams of a set which comprise at least two pairs of parallel banded beams, with one pair disposed at a relative angle to the other pair;

the measurement means is operable to measure the direction of movement of an edge relative to the intended direction;

by determinations associated with the ratio of the relative times, or differences in relative times, between changes in one parallel pair compared to another parallel pair;

the measurement means is operable to measure the speed of movement of the edge; and the distance between intersections between parallel pairs of cooperating banded beams is 50-60 mm.

13. An apparatus according to claim 9, wherein the banded beam generating means generates beams of a set which comprise:

at least two pairs of parallel banded beams, with one pair disposed at a relative angle to the other pair;

the measurement means is operable to measure the direction of movement of an edge relative to the intended direction;

by determinations associated with the ratio of the relative times, or differences in relative times, between changes in one parallel pair compared to another parallel pair;

the ratio of the relative times, or differences in relative times, between changes in one parallel pair compared to another parallel pair has a fixed relationship to the angle of club face direction and angles of the banded beams;

wherein a selection is made from a group comprising:

the banded beam generating means disposes the two pairs of parallel banded beams such that the intersections of both pairs lie along the line of the intended direction of the object or ball;

the banded beam generating means generates banded beams of a set which comprise one pair of banded beams disposed in one rotation at different acute angles to the intended direction of the object or ball and a second pair of banded beams disposed in the opposite rotation at different acute angles to the intended direction;

the measurement means is operable to measure the angle of the edge relative to the intended direction;

by determinations which recognize that the angle of the edge is indicated closer to the angle of banded beams which are changed later and is indicated further from the angle of banded beams which are changed sooner;

an increased difference between relative changes between banded beams of opposite rotation progressively indicates the movement characteristic to be angle rather offset;

a reduced difference between relative changes between banded beams of the same rotation, progressively indicates the movement characteristic to be offset rather than angle;

the banded beam generating means generates banded beams of a set which comprise two banded beams disposed in one rotation at different acute angles to the intended direction and a third banded beam disposed in the opposite rotation at an acute angle to the intended direction;

the measurement means is operable to measure the angle of the edge relative to the intended direction of the object or ball;

by determinations which recognize that the angle of the edge is indicated closer to the angle of banded beams which are changed later and is indicated further from the angle of banded beams which are changed sooner;

an increased difference between relative changes between banded beams of opposite rotation progressively indicates the movement characteristic to be angle rather offset;

a reduced difference between relative changes between banded beams of the same rotation, progressively indicates the movement characteristic to be offset rather than angle;

the banded beam generating means generates banded beams of a set which comprise one pair of banded beams disposed in one rotation at different acute angles to the intended direction of the object or ball and a second pair of banded beams disposed in the opposite rotation at different acute angles to the intended direction;

the measurement means is operable to measure the offset of the edge relative to the intended direction;

by determinations which recognize that the offset of the edge is indicated closer to the region comprising the most forward banded beam which are changed sooner and is indicated further from the region comprising banded beams which are changed later;

a reduced difference between relative changes between the two banded beams which are disposed in the same rotation, progressively indicates the movement characteristic to be offset rather than angle;

an increased difference between relative changes between banded beams of opposite rotation, progressively indicates the movement characteristic to be angle rather than offset;

the banded beam generating means generates banded beams of a set which comprise two banded beams disposed in one rotation at different acute angles to the intended direction and a third banded beam disposed in the opposite rotation at an acute angles to the intended direction of the object or ball;

the measurement means is operable to measure the offset of the edge relative to the intended direction;

by determinations which recognize that the offset of the edge is indicated closer to the region comprising the most forward banded beam which are changed sooner and is indicated further from the region comprising banded beams which are changed later;

a reduced difference between relative changes between the two banded beams which are disposed in the same rotation, progressively indicates the movement characteristic to be offset rather than angle;

an increased difference between relative changes between banded beams of opposite rotation, progressively indicates the movement characteristic to be angle rather than offset;

the banded beam generating means disposes the banded beams such that they intersect at a common point which lies along the line of the intended direction; and the banded beam generating means disposes the banded beams such that the magnitudes of banded beams of opposite rotation are equal.

14. An apparatus according to claim 9, which is operable to measure or determine movement characteristics of a ball struck by the implement and where a selection of one or more is made from a group comprising:

the banded beam generating means generates banded beams of a set which comprise:

at least two pairs of parallel banded beams, with each pair disposed at a relative angle to the other;

the measurement means is operable to measure the direction of movement of the ball relative to the intended direction of the ball;

by determinations associated with the ratio of the relative times, or differences in relative times, between changes in one parallel pair compared to another parallel pair;

the measurement means is operable to measure the direction of movement of the ball relative to the intended direction of the ball;

where the banded beams of a set comprise at least two banded beams, with one banded beam disposed at a relative angle to the other banded beam;

by measuring a change as the ball first disrupts the banded beam and measures a second change when the banded beam is reinstated when the object passes through it;

by determinations associated with the ratio of the relative times, or differences in relative times, between changes in one banded beam compared to the other banded beam;

the measurement means is operable to measure the direction of movement of the ball relative to the intended direction of the ball;

where the banded beams of a set comprise at least two banded beams, with one banded beam disposed at a relative angle to the other banded beam;

by measuring a change as the ball first disrupts the banded beam and measures a second change when the banded beam is reinstated when the object passes through it;

by determinations associated with the ratio of the relative times, or differences in relative times, between changes in one banded beam compared to the other banded beam;

the ratio of the relative times, or differences in relative times, between changes in one banded beam compared to the other banded beam has a fixed relationship to the angle of ball direction and angles of the banded beams;

the measurement means is operable to measure the direction of movement of the ball relative to the intended direction of the ball;

where the banded beams of a set comprise at least banded two beams, with one banded beam disposed at a relative angle to the other banded beam;

by measuring a change as the ball first disrupts the banded beam and measures a second change when the banded beam is reinstated when the object passes through it;

by determinations associated with the ratio of the relative times, or differences in relative times, between changes in one banded beam compared to the other banded beam and the measurement means is operable to measure the speed of movement of the ball; and by determining speed as distance divided by time, with time determined by the duration between the ball effecting a disruption and reinstatement changes on one of the banded beams, and distance determined by application of the determined direction of movement to the known geometry of the ball and banded beam.

15. An apparatus according to claim 9, which is operable to measure or determine movement characteristics of a ball struck by the implement, and the banded beam generating means generates beams of a set which comprise:

at least two pairs of parallel banded beams, with each pair disposed at a relative angle to the other;

the measurement means is operable to measure the direction of movement of the ball relative to the intended direction of the ball;

by determinations associated with the ratio of the relative times, or differences in relative times, between changes in one parallel pair compared to another parallel pair;

where a selection of one or more is made from a group comprising:

the ratio of the relative times, or differences in relative times, between changes in one parallel pair compared to another parallel pair has a fixed relationship to the angle of ball direction and angles of the banded beams;

the measurement means is operable to measure the speed of movement of the ball, by determining speed as distance divided by time, with time determined by the duration between the object effecting a changes on two parallel banded beams of one of the pairs of banded beams, and distance determined by application of the determined direction of movement to the distance between the parallel banded beams; and the banded beam generating means disposes the two pairs of parallel banded beams such that the intersections of both pairs lie along the line of the intended direction of the ball.

16. An apparatus according to claim 9, which is operable to measure or determine movement characteristics of a ball struck by the implement, wherein the measurement means is operable to measure the direction of movement of the ball relative to the intended direction of the ball, and where a selection of one or more is made from a group comprising:

the measurement means is operable to measure the direction of movement of the ball relative to the intended direction of the ball;

where the banded beams of a set comprise at least two banded beams, with one beam disposed at a relative angle to the other banded beam;

the ball commences or continues motion from a known position and at a known time;

by determinations associated with the ratio of the relative times, or differences in relative times, between changes in one beam compared to the other banded beam;

the ratio of the relative times, or differences in relative times, between changes in one banded beam compared to the other banded beam has a fixed relationship to the angle of ball direction and angles of the banded beams;

the measurement means is operable to measure the speed of movement of the ball;

by determining speed as distance divided by time, with time determined by the duration between the ball effecting a change in one of the banded beams, and distance determined by application of the determined direction of movement to the known distance between the banded beam and the known position; and the known position lies along the line of the intended direction of the ball.

17. An apparatus according to claim 9, wherein the banded beam generating means are operable to generate banded beams which comprise substantially flat elongate bands and where a selection of one or more is made from a group comprising:

the banded beam has a cross section where the width is far greater than the thickness;

the width of the cross section is orthogonal to the common plane;

the banded beam has a thickness of 0.5 mm to 2 mm; and the banded beam has a thickness of approximately 1 mm.

18. An apparatus according to claim 9, wherein the banded beam generating means are operable to generate banded beams which comprise substantially flat elongate bands and the banded beam has a cross section where the width is greater than the thickness and where a selection of one or more is made from a group comprising:

the measurement means detects any alteration to the banded beam, caused by an object or ball entering any point on the cross section of the beam and partly obscuring it;

the measurement means detects an alteration to the banded beam, caused by an object or ball departing the banded beam and ceasing to partly obscure it;

the measurement means is operable to measure a banded beam as the object or ball passes through it and make a record of the maximum measured degree to which the banded beam is obscured, and make a determination of the position of the edge of the object or ball relative to the width of the cross section of the banded beam using the record made of the maximum degree to which the banded beam is obscured;

two beam generating means, each of which is operable to determine a movement characteristic of an object or ball, where one operates over a shorter length along the direction of travel of the object or ball than the other, but covers a wider range of angular variation in the plane which comprises the large dimension of the cross section of the banded beam;

the banded beam generating means comprises an emitter means which is operable to generate a banded beam where the thickness of the cross section is significantly greater than that which is required for measurement;

the banded beam is such that measurement can be taken at a plurality of positions across the transmitted cross section, and the measurement means is operable to determine measurements using a cross section with a thickness which is significantly less than the transmitted cross section;

the banded beam generating means comprises an emitter means which is operable to generate a banded beam where the thickness of the cross section is significantly greater than that which is required for measurement; and the banded beam is such that measurement can be taken at a plurality of positions across the transmitted cross section and the measurement means is operable to determine measurements using a cross section with a thickness which is significantly less than the transmitted cross section and includes a screening means which determines the measured thickness of the cross section of the beam on the receiving side of the banded beam.

19. An apparatus according to claim 9, wherein the banded beam generating means or emitter means is operable to generate banded beams as electromagnetic wave banded beams and where the detection means is operable to detect such banded beams and where a selection of one or more is made from a group comprising:

the emitting means includes an emitter which is a laser diode;

the emitting means includes an emitter which is a laser diode, the laser diode comprises different axes of divergence and the axis of greatest divergence is aligned to the width of the banded beam and the axis of lesser divergence is aligned to the thickness of the banded beam;

the emitting means includes an emitter which is a laser diode, the laser diode emits radiation of near infrared wavelength;

the emitter means includes a lens which modifies the banded beam from an emitter;

the emitter means includes a lens which modifies the banded beam from an emitter, the lens is operable to focus a banded beam of two different divergence axes such that the axis of lesser divergence is focused into a banded beam with a much smaller degree of divergence;

the emitter means includes a lens which modifies the banded beam from an emitter, the lens is operable to focus a banded beam of two different divergence axes such that the axis of greater divergence is focused to a banded beam with greater divergence;

the emitter means includes a lens which modifies the banded beam from an emitter, the lens is operable to modify a banded beam which varies in intensity across its cross section, by relative positive magnification of areas of lower intensity and relative negative magnification of areas of higher intensity;

focused reflection by a reflection means is replaced by focused transmission by a lens;

the emitter means is operable to generate adjacent banded beams which are pulsed at different frequencies and where the measurement means is operable to measure at the frequency of the corresponding emitter means and to disregard banded beams detected at other frequencies;

the measurement means includes an electronic processor means which includes an analogue trigger which is operable to determine the initial interruption of a banded beam;

the measurement means includes an electronic processor means which includes an analogue trigger which is operable to determine the initial interruption of a banded beam;

the analogue trigger includes a Schmitt trigger which activates when a voltage output from a photodiode falls by a small preset amount below a steady state level;

the measurement means includes an electronic processor means which is operable to track the output of a detector, such as a photodiode, at high speed, and to record its lowest value;

the measurement means includes an electronic processor means which is operable to track the output of a detector, such as a photodiode, at high speed, and to record its lowest value; and the measurement means is operable to determine a position of the object in relation to the banded beam by comparing the lowest value, relative to the steady state signal which was present before or after the banded beam was interrupted and comparing it to a set of conversion values.

20. An apparatus according to claim 9, wherein the banded beam generating means or emitter means is operable to generate banded beams as electromagnetic wave banded beams and where the detection means is operable to detect such banded beams, the emitter means includes a reflection means and where a selection of one or more is made from a group comprising:

the reflection means is operable to focus a diverging banded beam into a parallel or near parallel banded beam;

the reflection means is operable to focus a diverging banded beam into a parallel or near parallel banded beam with a small degree of divergence;

the reflection means is operable to focus an obliquely incident diverging banded beam into a parallel or near parallel, substantially orthogonal, banded beam with a small degree of convergence;

the reflection means is operable to focus a near parallel banded beam onto a detector;

the reflection means is operable to focus a parallel or near parallel banded beam which is substantially orthogonal, to an obliquely incident converging banded beam onto a detector;

the reflection means is of a substantially flat shape and comprises an array of reflecting facets;

the reflection means comprises a plurality of arrays of reflecting facets;

the reflection means comprises a polymer injection molding;

the reflection means is interchangeable and is provided in different sizes or arrangements which are operable to produce banded beams or sets of beams of different sizes or arrangement;

the reflection means is interchangeable and the apparatus is provided with a plurality of mounting positions for a reflection means, disposed at different distances from the ball starting position; and an emitter reflector and a detection reflector, wherein the emitter reflector is operable to focus a banded beam to the detection reflector, the detection reflector is operable to receive it, and the height or long dimension of one of the reflectors is greater than the height or long dimension of the other reflector.

21. An apparatus according to claim 9, wherein the measurement means includes an artificial neural-type intelligence means.

22. An apparatus according to claim 9, where a selection of one or more is made from a group comprising:

elements of the detection means, including the detectors, are positioned below the level of the banded beams;

elements of the emitter means, including the emitters, are positioned below the level of the banded beams;

which includes an emitter reflection means, where the banded beam generating means share one or more common emitters; and the common emitters are located forward of the banded beams and on the same side of the ball starting position as the detection means.

23. An apparatus according to claim 9, where a selection of one or more is made from a group comprising:

each banded beam generating means comprises one emitter and one detector;

an emitter reflection means and banded beam generating means comprise emitters and detectors, where the emitters and detectors are located on opposite sides of the commencing position of the ball;

an emitter reflection means and banded beam generating means comprise emitters and detectors, where the emitters and detectors are located on the opposite sides of the commencing position of the ball, the emitters and detectors are located on the same sides of the apparatus relative to the commencing position of the ball, where banded beams are returned along the same path by a reflection means;

an emitter reflection means and banded beam generating means comprise emitters and detectors, where the emitters and detectors are located on opposite sides of the commencing position of the ball, the emitters and detectors are located on the same sides of the apparatus relative to the commencing position of the ball, where banded beams are returned along the same path by a reflection means;

where the reflection means comprises a retroreflective surface;

which includes an emitter reflection means and each banded beam generating means comprises one emitter and one detector, wherein the emitters and detectors are located on opposite sides of the commencing position of the ball, the emitters and detectors are located on the same sides of the apparatus relative to the commencing position of the ball, where banded beams are returned along the same path by a reflection means;

where the reflection means comprises a retroreflective surface;

where the retroreflective surface comprises corner cubes with three reflective faces at 90° to each other;

which includes an emitter reflection means and each banded beam generating means comprises emitters and detectors, where the emitters and detectors are located on opposite sides of the commencing position of the ball, the emitters and detectors are located on the same sides of the apparatus relative to the commencing position of the ball, where banded beams are returned along the same path by a reflection means;

which includes a common emitter and detection reflection means;

which includes an emitter reflection means and each banded beam generating means comprises emitters and detectors, wherein the emitters and detectors are located on opposite sides of the commencing position of the ball, the emitters and detectors are located on the same sides of the apparatus relative to the commencing position of the ball, where banded beams are returned along the same path by a reflection means; and where banded beams are separated by a partly reflective mirror.

24. An apparatus according to claim 9, wherein the implement is a golf club and the ball is struck by the implement from a known or rest position.

* * * * *